US008186369B2

(12) United States Patent
Reeb et al.

(10) Patent No.: US 8,186,369 B2
(45) Date of Patent: May 29, 2012

(54) COLLAPSIBLE SHELTER

(75) Inventors: David Reeb, Columbia, MD (US); Paul Robinette, Phoenix, AZ (US)

(73) Assignee: Swimways Corporation, Virginia Beach, VA (US)

( * ) Notice: Subject to any disclaimer, the term of this patent is extended or adjusted under 35 U.S.C. 154(b) by 107 days.

(21) Appl. No.: 12/153,183

(22) Filed: May 14, 2008

(65) Prior Publication Data

US 2009/0283123 A1 Nov. 19, 2009

(51) Int. Cl.
*E04H 15/34* (2006.01)
*E04H 15/48* (2006.01)

(52) U.S. Cl. ..... 135/144; 135/135; 135/147; 135/151; 52/81.3

(58) Field of Classification Search ..... 135/124, 135/135–136, 143–145, 157, 151, 905, 907; 52/79.5, 83, 80.1–80.3, 81.1, 81.4
See application file for complete search history.

(56) References Cited

U.S. PATENT DOCUMENTS

| | | | | |
|---|---|---|---|---|
| 1,190,999 | A | 7/1916 | Harris | |
| 1,502,898 | A | 7/1924 | Berg | |
| 1,820,002 | A | 8/1931 | Forrester | |
| 1,853,367 | A * | 4/1932 | Mace | 135/123 |
| 2,808,846 | A | 10/1957 | Jonsson | |
| 2,864,389 | A | 12/1958 | Smith et al. | |
| 2,948,287 | A | 8/1960 | Rupert | |
| 2,953,145 | A | 9/1960 | Moss et al. | |
| 3,037,517 | A | 6/1962 | Zent | |
| 3,738,378 | A | 6/1973 | Williams | |
| 3,874,397 | A | 4/1975 | Oberhaus | |
| 3,929,146 | A | 12/1975 | Maiken | |
| 4,074,682 | A | 2/1978 | Yoon | |
| 4,192,334 | A | 3/1980 | Daws | |
| 4,195,651 | A | 4/1980 | Watts et al. | |
| 4,201,237 | A | 5/1980 | Watts et al. | |
| 4,202,363 | A | 5/1980 | Watts et al. | |
| 4,491,141 | A | 1/1985 | Eppenbach | |
| 4,607,656 | A | 8/1986 | Carter | |

(Continued)

FOREIGN PATENT DOCUMENTS

JP 07-018923 1/1995

(Continued)

OTHER PUBLICATIONS

Changing Room Quick Tent, Product information from Qyield Camping Products Co., Ltd., 1 page.

(Continued)

*Primary Examiner* — Winnie Yip
(74) *Attorney, Agent, or Firm* — Cooley LLP

(57) ABSTRACT

In one embodiment, a shelter includes a first hub configured to be moveably coupled to a plurality of support linkages. The shelter excludes a second hub different than the first hub. The shelter includes a support linkage from the plurality of support linkages. The support linkage is pivotally coupled to the first hub. The support linkage is moveable between a collapsed configuration and an expanded configuration. The support linkage includes a first member and a second member pivotally coupled to the first member. An angle formed by an intersection between a longitudinal axis defined by the first member and a longitudinal axis defined by the second member is less than 180 degrees when the support linkage is in its collapsed configuration. The angle is greater than 180 degrees when the support linkage is in its expanded configuration.

44 Claims, 19 Drawing Sheets

U.S. PATENT DOCUMENTS 4,750,509 A 6/1988 Kim
4,858,634 A 8/1989 McLeese
4,924,896 A 5/1990 Carter
4,945,936 A 8/1990 Surrendi
4,966,178 A 10/1990 Eichhorn
4,998,552 A 3/1991 Niksic et al.
5,036,874 A 8/1991 Lynch
5,038,812 A 8/1991 Norman
5,046,882 A 9/1991 Ju
5,067,505 A 11/1991 Cantwell et al.
5,117,852 A 6/1992 Bryant
5,137,044 A 8/1992 Brady
5,163,461 A 11/1992 Ivanovich et al.
5,195,551 A 3/1993 Ju
5,230,358 A 7/1993 Forell
5,249,592 A 10/1993 Springer et al.
5,328,286 A 7/1994 Lee
5,333,634 A 8/1994 Taylor
5,361,794 A 11/1994 Brady
5,363,626 A 11/1994 Hanninen
5,411,046 A 5/1995 Wan
5,462,330 A 10/1995 Brown
5,485,863 A 1/1996 Carter
5,490,533 A 2/1996 Carter
5,499,646 A 3/1996 Lee
5,511,572 A 4/1996 Carter
5,590,674 A 1/1997 Eppenbach
5,601,105 A 2/1997 Blen et al.
5,632,292 A 5/1997 Carter
5,632,293 A 5/1997 Carter
5,666,986 A 9/1997 Fox
5,676,168 A 10/1997 Price
5,794,546 A 8/1998 Carter
5,797,412 A 8/1998 Carter
5,797,695 A 8/1998 Prusmack
5,813,425 A 9/1998 Carter
5,865,127 A 2/1999 Carter
5,884,646 A 3/1999 Ju
5,915,400 A 6/1999 Pohl et al.
5,921,260 A 7/1999 Carter
5,934,301 A 8/1999 Carter
5,943,837 A 8/1999 Esser et al.
5,944,040 A 8/1999 Jang
6,021,795 A 2/2000 Long et al.
6,041,800 A 3/2000 Carter
6,070,604 A 6/2000 Carter
6,076,312 A 6/2000 Carter
6,129,102 A 10/2000 Carter
6,138,702 A 10/2000 Carter
6,152,157 A 11/2000 Jang
6,170,504 B1 1/2001 Tsai
6,173,726 B1 * 1/2001 Talmadge ..... 135/144
6,192,910 B1 2/2001 Carter
6,230,729 B1 5/2001 Carter
6,240,940 B1 6/2001 Carter
6,257,263 B1 7/2001 Brereton
6,311,709 B1 11/2001 Louie et al.
6,325,086 B1 12/2001 Shinner et al.
6,336,465 B1 1/2002 Surrendi et al.
6,345,639 B2 * 2/2002 Rousselle et al. ..... 135/128
6,357,461 B1 3/2002 Chai et al.
6,361,057 B1 3/2002 Carter
6,363,956 B2 4/2002 Carter
6,371,143 B1 4/2002 Swetish
6,374,842 B1 4/2002 Carter
6,382,224 B1 5/2002 Carter
6,397,872 B1 6/2002 Carter
6,412,507 B1 7/2002 Carter
6,431,193 B2 8/2002 Carter
6,439,251 B2 8/2002 Carter
6,463,948 B2 10/2002 Lee
6,470,902 B1 10/2002 Carter
6,502,597 B2 1/2003 Carter
6,520,196 B2 2/2003 Carter
6,581,617 B2 6/2003 Ham et al.
6,615,552 B2 9/2003 Gillis
6,681,786 B2 1/2004 Ju
6,776,179 B1 8/2004 Chen
6,796,320 B2 9/2004 Carter
6,802,329 B2 10/2004 Chen
6,854,476 B1 2/2005 Chai
7,152,614 B2 12/2006 Kalnay
7,174,908 B2 2/2007 Chen
7,178,537 B2 2/2007 Holub
7,185,666 B2 3/2007 Chai
7,201,177 B2 4/2007 Anticoli et al.
7,267,135 B2 9/2007 Hardee et al.
7,290,553 B2 11/2007 Prevost
7,644,721 B2 * 1/2010 Hoberman et al. ..... 135/144
2003/0024562 A1 2/2003 Liu
2004/0238021 A1 12/2004 Holub et al.
2005/0005961 A1 1/2005 Chang
2005/0081903 A1 4/2005 Wang
2005/0224107 A1 10/2005 Yang
2006/0076045 A1 4/2006 Lee
2006/0159868 A1 * 7/2006 Hoberman et al. ..... 428/12
2006/0231129 A1 10/2006 Ferraro, Sr. et al.
2007/0023074 A1 2/2007 Choi
2007/0051399 A1 3/2007 Jung
2007/0062569 A1 3/2007 Joo-Tai

FOREIGN PATENT DOCUMENTS

JP 7-139228 5/1995
JP 2000-291295 A 10/2000

OTHER PUBLICATIONS

Quick Fishing Tent, Qyield Camping Products Co., Ltd., [online] [Retrieved on Dec. 23, 2008] Retrieved from URL:http://www.qycamping.com/Product.asp?clause=2&id=4&NoDown_TypeID=1, 3 pages.

Flash Touch Tent—Classic Nest, Qyield Camping Products Co., Ltd., [online] [Retrieved on Dec. 23, 2008] Retrieved from URL:http://www.qycamping.com/Product.asp?clause=2&id=54&NoDown_TypeID=1, 3 pages.

Flash Touch Tent—Mini Moon Nest, Qyield Camping Products Co., Ltd., [online] [Retrieved on Dec. 23, 2008] Retrieved from URL:http://www.qycamping.com/Product.asp?clause=2&id=53&NoDown_TypeID=1, 3 pages.

Flash Touch Tent—Chameleon, Product information from Qyield Camping Products Co., Ltd., 1 page.

SUV Tent, Product information from Qyield Camping Products Co., Ltd., 1 page.

* cited by examiner

COLLAPSIBLE SHELTER

BACKGROUND

This invention relates generally to a shelter having multiple configurations, and in particular, to a shelter, such as a tent, that can be disposed in an expanded configuration and in a collapsed configuration.

Known collapsible tents can be used to shelter a user. Such collapsible tents are often transported and used in various outdoor settings, such as in a backyard or at a campground. Known collapsible tents, however, are typically difficult to setup and often take two or more people to setup. The collapsible tents often cannot be moved in a direction normal to a support surface such that the collapsible tent moves from a first configuration to a second configuration in one continuous movement. Such known collapsible tents typically have at least a portion of a tent frame outside of a tent canopy and, thus, exposed to the environment, which can facilitate rusting of the tent frame.

A need, therefore, exists for a collapsible that can be easily converted between an expanded configuration and a collapsed configuration for example by a single user with a continuous vertical movement.

SUMMARY OF THE INVENTION

In one embodiment, a shelter includes a first hub configured to be moveably coupled to a set of support linkages. The shelter excludes a second hub different than the first hub. The shelter includes a support linkage from the set of support linkages. The support linkage is pivotally coupled to the first hub. The support linkage is moveable between a collapsed configuration and an expanded configuration. The support linkage includes a first member and a second member pivotally coupled to the first member. An angle formed by an intersection between a longitudinal axis defined by the first member and a longitudinal axis defined by the second member is less than 180 degrees when the support linkage is in its collapsed configuration. The angle is greater than 180 degrees when the support linkage is in its expanded configuration.

In another embodiment, an apparatus includes a frame configured to be moved between a collapsed configuration and an expanded configuration. The frame includes a first support linkage, a second support linkage, and a third support linkage. The first support linkage, the second support linkage and the third support linkage collectively form an interior region when the frame is in the expanded configuration. A flexible shell is coupled to the frame exterior, of the interior region. The flexible shell is configured to be elastically deformed when the frame is in the expanded configuration such that the frame is maintained in the expanded configuration. The frame and the flexible shell collectively form a collapsible portable shelter.

In yet another embodiment, a shelter includes a frame being moveable between a collapsed configuration and an expanded configuration. The frame includes a set of rigid support linkages. The shelter includes a membrane coupled to the frame. The membrane and the frame are configured to collectively define an interior region when the frame is in the expanded configuration. The membrane is configured to exert a force on the frame when the frame is in its expanded configuration such that movement of the frame from the expanded configuration to the collapsed configuration is resisted.

In still yet another embodiment, the apparatus includes one and only one hub configured to be movably coupled to a set of support linkages. The shelter includes a support linkage from the set of support linkages. The support linkage is moveable between a collapsed configuration and an expanded configuration. The support linkage and the hub collectively form a portion of a collapsible portable shelter. The support linkage includes a first member pivotally coupled to the hub at one and only one location of the hub. The support linkage includes a second member pivotally coupled to the first member, a third member pivotally coupled to the second member and a fourth member pivotally coupled to the third member.

In another embodiment, an apparatus includes a first support linkage, a second support linkage and a hub movably coupled to the first support linkage and the second support linkage. The first support linkage is moveable between a collapsed configuration, an expanded configuration and an intermediate configuration. The intermediate configuration is between the collapsed configuration and the expanded configuration. The first support linkage includes a first member pivotally coupled to the hub, a second member pivotally coupled to the first member, a third member pivotally coupled to the second member and a fourth member pivotally coupled to the third member. An angle formed by an intersection between a longitudinal axis defined by the second member and a longitudinal axis defined by the third member is less than 180 degrees when the first support linkage is in its collapsed configuration. The angle being greater than 180 degrees when the first support linkage is in its expanded configuration. The second support linkage is moveable between a collapsed configuration, an expanded configuration and an intermediate configuration. The intermediate configuration of the second support linkage is between the collapsed configuration of the second support linkage and the expanded configuration of the second support linkage. The first support linkage is independently moveable with respect to the second support linkage when moved between its collapsed configuration and its intermediate configuration. The hub, the first support linkage and the second support linkage collectively form a portion of a collapsible portable shelter.

In yet another embodiment, an apparatus includes a hub configured to be movably coupled to a set of support linkages and a support linkage from the set of support linkages. The support linkage is moveable between a collapsed configuration and an expanded configuration. The support linkage includes a first member pivotally coupled to the hub, a second member pivotally coupled to the first member, a third member pivotally coupled to the second member and a fourth member pivotally coupled to the third member. The hub is configured to maintain the support linkage in the collapsed configuration without external support such that a longitudinal axis defined by the fourth member is substantially normal to a plane defined by a support surface when the support linkage is in the expanded configuration. An angle formed by an intersection between the longitudinal axis defined by the second member and a longitudinal axis defined by the third member is greater than 180 degrees when the support linkage is in the expanded configuration. The hub and the support linkage collectively form a portion of a collapsible portable shelter.

In another embodiment, a tent includes a tent frame that can be moved between a collapsed configuration and an expanded configuration. The tent frame has a set of support linkage. At least one support linkage from the set of support linkage includes an elongate member. The elongate member can be anchored to a support surface when the tent frame is in the expanded configuration. The tent frame has a first hub that can be moveably coupled to the set of support linkages. The tent excludes a second hub different than the first hub. The first hub can maintain the tent frame in the collapsed configuration such that when a portion of the first hub is in contact with the support surface a longitudinal axis of the elongate member is substantially normal to the support surface.

BRIEF DESCRIPTION OF THE DRAWINGS

The invention is described with reference to the accompanying drawings.

DETAILED DESCRIPTION

Figure 1:
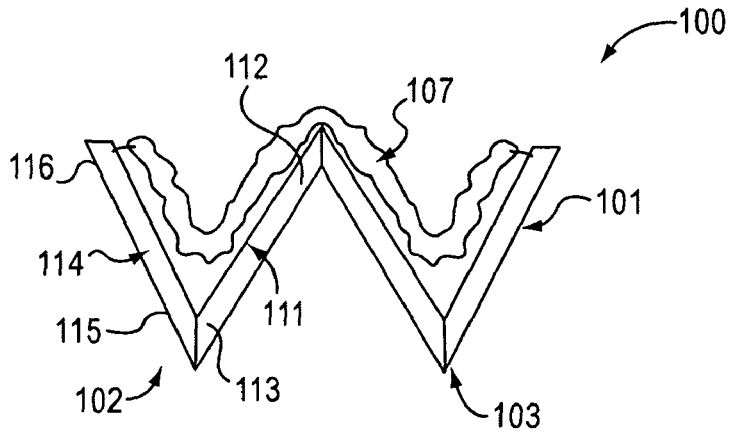
FIGS. 1 and 2 are schematic illustrations of a shelter disposed in a collapsed configuration and an expanded configuration, respectively, according to an embodiment.

A shelter, such as, for example, a collapsible portable tent can be set up (i.e., moved between a collapsed configuration and an expanded configuration) without requiring the assembly and/or installation of separate and disconnected frame members (i.e., tent poles). Said another way, the shelter can be set up in one continuous operation. The shelter includes a rigid frame and a fabric tent covering. The rigid frame remains coupled to the fabric tent covering when the shelter is moved between its collapsed configuration and its expanded configuration. In this manner, a user can move the shelter from its collapsed configuration to its expanded configuration in one continuous operation by moving a center portion upward. This arrangement expands the tent without requiring the assembly of separate and disconnected portions of the rigid frame and/or without requiring installation of portions of the rigid frame into the fabric tent covering.

In some embodiments, the rigid frame includes four support linkages coupled together by a central hub. The support linkages can be coupled to the inside surface of the fabric tent covering by any suitable means. For example, the support linkages can be disposed within pockets formed by the fabric tent covering. In another example, the support linkages can be coupled to the fabric tent covering by adhesive, cords, hook and loop fasteners or the like.

Each of the four support linkages includes four members pivotally coupled together. Specifically, each support linkage includes a first member, a second member, a third member and a fourth member. The first member can be movably coupled to the central hub. The second member can be pivotally coupled to the first member. The third member can be pivotally coupled to the second member. The fourth member can be pivotally coupled to the fourth member. The fourth member can be coupled to the base of the shelter. Accordingly, when the shelter is anchored (e.g., staked to the ground), the lower end of the fourth member is constrained.

In use, the user can move the shelter from its collapsed configuration to its expanded configuration in one operation by moving the central hub upward. The upward movement of the central hub coupled by the constraint of the lower end of the fourth member causes the support linkage to unfold from its collapsed configuration, M-like shape to its expanded configuration. When the support linkage is in its expanded configuration, the fourth member is disposed substantially normal to the ground. Additionally, when the support linkage moves from its collapsed configuration to its expanded configuration, the angle between the second member and the third member changes from an angle less than 180 degrees to an angle greater than 180 degrees. Said another way, the second member and the third member can rotate relative to each other by an angle greater than 180 degrees. Accordingly, the kinematic relationship of the members results in a shelter having a greater inside volume (e.g., head room) than is found in, for example, dome tents.

As stated above, the fabric tent covering is coupled to the rigid frame. The fabric tent covering produces a force on the frame sufficient to maintain the frame in its expanded configuration. Specifically, the fabric tent covering provides a force at each joint of the frame (e.g., locations at which two members are coupled) such that the joints resist movement from the expanded configuration to the collapsed configuration when the shelter is disposed in the expanded configuration. In other words, the elasticity of the fabric tent covering helps maintain the shelter in its expanded configuration once disposed in its expanded configuration.

A support linkage can be defined as, for example, two or more members/links movably coupled together. For example, a support linkage can be a first member and a second member where the first member is pivotally, slidably or rotatably coupled to the second member. Each member is coupled to at least one other member at at least one location/point, such as, for example, a joint. The support linkage can include a coupling member. The control member can be, for example, a screw, a pin, a plate with multiple apertures, etc. The coupling member may or may not have a locking mechanism. The coupling member may or may not have a biasing mechanism.

A hub can be defined as, for example, a member used to control/dictate motion of the frame between configurations. Similarly stated, the hub can be movably coupled to multiple support linkages such that a movement of the hub results in a movement of the support linkages. Similarly stated, each member of the frame is moved from a first position to a second position when the hub is moved from a first position to a second position different than its first position. The hub can be designed for a user to move or actuate a shelter from a first configuration to a second configuration different than the first configuration. In some embodiments, the hub is at the apex of the frame when the frame is in an expanded configuration.

In some embodiments, the hub is movably coupled to three or more support linkages. In some embodiments, two of the support linkages can collectively define a plane angularly offset from a longitudinal axis defined by other support linkages. In some embodiments, the various support linkages are equally angularly spaced from one another.

In some embodiments, the hub differs from the coupling member as described herein. A movement by the hub from a first position to a second position moves each coupling member from a first position to a second position regardless of the configuration of the frame. An outward movement by the coupling member from a first position to a second position may or may not move the hub, and does not move other support linkages including any of their respective coupling members.

Figure 2:
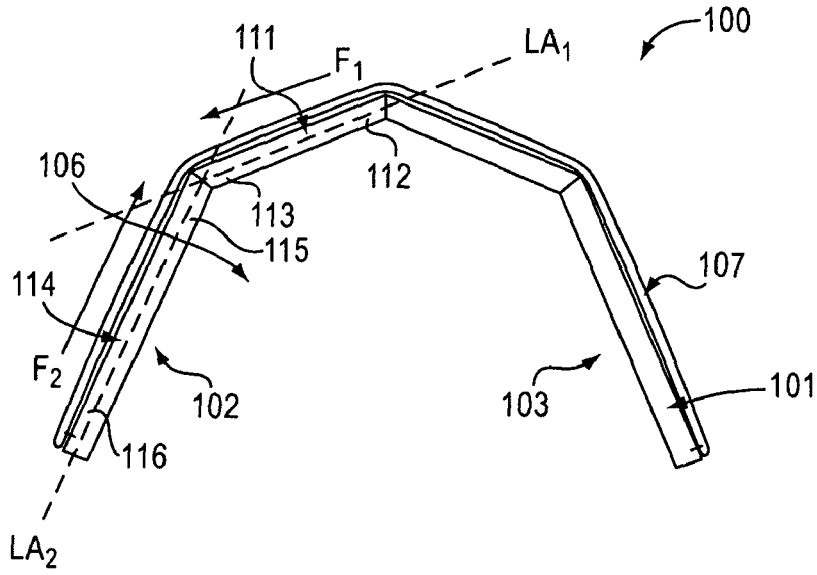

FIGS. 1 and 2 are schematic illustrations of a shelter disposed in a collapsed configuration and an expanded configuration, respectively, according to an embodiment. As shown in FIG. 1, an apparatus 100 (also referred herein as a "shelter") includes a flexible shell 107 (also referred herein as a "membrane") and a frame 101.

The frame 101 has a first support linkage 102 and a second support linkage 103. The second support linkage 103 is a mirror of the first support linkage 102 and includes similar components and similar functions. Thus, only the first support linkage 102 will be described in detail. In some embodiments, the frame has more than two support linkages having similar components with similar functions.

The first support linkage 102 includes a rigid first member 111 and a rigid second member 114. The first member 111 has a first end portion 112 and a second end portion 113 opposite the first end portion 112. The second member 114 has a first end portion 115 and a second end portion 116 opposite the first end portion 115. The second end portion 113 of the first member 111 is pivotally coupled to the first end portion 115 of the second member 114. The first end portion 112 of the first member 111 is movably coupled to the second support linkage 103. In other words, the first member 111 can rotate relative to the second member 114. As used herein, one member can rotate relative to another member when that one member is pivotally coupled or movably coupled to the other member. The second end portion 116 of second member 114 can be anchored to a support surface (not shown).

The collapsible shelter 100 can move between a collapsed configuration and an expanded configuration as shown in FIGS. 1 and 2, respectively. The frame 101 also can move between a collapsed configuration and an expanded configuration. The membrane 107, the first support linkage 102 and the second support linkage 103 collectively form an interior region 106 when the frame 101 is in the expanded configuration. In some embodiments, the interior region is collectively defined by the membrane, the first support linkage, the second support linkage and other support linkages (not shown). In some embodiments, the collapsible shelter 100 is portable when in the collapsed configuration.

The membrane 107 is coupled to the frame 101 exterior of the interior region. Specifically, the membrane 107 is coupled to the second end portion 116 of the second member 114 and coupled to the second support linkage 103. The membrane 107 is not taut (e.g., loose) when the frame 101 is in the collapsed configuration as shown in FIG. 1. The membrane 107 becomes elastically deformed when the frame 101 is moved from the collapsed configuration to the expanded configuration due to outward movement of first support linkage 102 and the second support linkage 103. Said another way, the membrane 107 has a first length when the frame 101 is in the collapsed configuration. The membrane 107 has a second length when frame 101 is in the expanded configuration. The second length is greater (i.e., larger) than the first length.

As discussed above, the membrane 107 can maintain the frame 101 in the expanded configuration when in the expanded configuration. Specifically, as the membrane 107 becomes elastically deformed, the membrane 107 produces and exerts (e.g., applies, imparts, etc.) a force on the frame 101 when the frame 101 is in the expanded configuration such that movement of the frame 101 from the expanded configuration to the collapsed configuration is resisted. The membrane 107 is elastically deformed when the frame 101 is in the expanded configuration such that the frame 101 is maintained in the expanded configuration. In other words, the membrane 107 is elastically deformed such that the membrane 107 imparts a force on the frame 101 sufficient to maintain the frame 101 in the expanded configuration when the frame 101 is in the expanded configuration.

As shown in FIG. 2, the membrane 107 exerts a force on the frame 101 along direction $F_1$ and a force on the frame 101 along direction $F_2$. The directions $F_1$ and $F_2$ are substantially parallel to a longitudinal axis $LA_1$ of the first member 111 and a longitudinal axis $LA_2$ of the second member 114, respectively. Specifically, the force along direction $F_1$ and the force along direction $F_2$ intersect at or near the coupling of second end portion 113 of the first member 111 to the first end portion 115 of the second member 114 to maintain their respective position and resist movement of the frame 101 from the expanded configuration to the collapsed configuration. Said differently, the force along direction $F_1$ and the force along direction $F_2$ collectively resist rotational movement of the first member 111 and the second member 114 towards a 180 degree ($\pi$ radian) angle formed by the longitudinal axis $LA_1$ of the first member 111 and the longitudinal axis $LA_2$ of the second member 114. Although the forces on the joint formed by the coupling of the second end portion 113 of the first member 111 and the first end portion 115 of the second member 114 are described in detail, it should be understood that similar forces are acting upon each joint formed by a coupling of two or more components such that the two or more components resist movement from the expanded configuration to the collapsed configuration when the frame 101 is in the expanded configuration.

The first support linkage 102 can be moveable between a first configuration corresponding to the collapsed configuration, a second configuration corresponding to the expanded configuration and a third configuration corresponding to an intermediate configuration between the first configuration and the second configuration. In other words, the first support linkage can move through the third configuration when the first support linkage 102 is moved between the first configuration and the second configuration. The frame 101 can deform the membrane 107 by a first amount when in the collapsed configuration. The frame 101 can deform the membrane 107 by a second amount when in the expanded configuration. The frame 101 can deform the membrane 107 by a third amount when the frame 101 is in the intermediate configuration. The third amount is greater than the first amount and the second amount. Accordingly, when the frame 101 is in the expanded configuration, the membrane 107 can exert a force on the frame 101 such that movement of the frame 101 from the expanded configuration to the collapsed configuration is resisted.

In some embodiments, the first support linkage can include a third member (not shown) pivotally coupled to the second member. An angle formed by an intersection between a longitudinal axis defined by the second member and a longitudinal axis defined by the third member is less than 180 degrees ($\pi$ radian) when the first support linkage is in its first configuration (i.e., its collapsed configuration) such that the membrane is deformed by a first amount. The angle is greater than 180 degrees when the first support linkage is in the second configuration (i.e., its expanded configuration) such that the membrane is deformed by a second amount. The angle is equal to 180 degrees when the first support linkage is in the third configuration (i.e., at one instance in its intermediate configuration) such that the membrane is elastically deformed by a third amount greater than the first amount and the second amount.

In some embodiments, the first support linkage and the second support linkage are coupled via one and only one hub. The first support linkage is coupled to one and only one location of the hub. The hub can include a locking member that can move between a first position and a second position different than the first position. The locking member can prevent at least one of the support linkages from pivoting relative to the hub when the locking member is in its second position. Specifically, for example, the locking member can maintain the frame in its expanded configuration when the locking member is in its second position and the frame is disposed in its expanded configuration. In other embodiments, the locking member can move from the first position to the second position when the frame is moved from its collapsed configuration to its expanded configuration. In yet other embodiments, the hub can maintain the frame in a position such that the longitudinal axis defined by the end portion of the first support linkage is substantially normal to the plane defined by the support surface without external support when the frame is in the collapsed configuration. Said another way, the hub can maintain the frame in a position such that the longitudinal axis of the end portion of the first support linkage is substantially normal to the plane defined by the support surface without external support when the frame is in the collapsed configuration. In some embodiments, a longitudinal axis defined by an end portion of the first support linkage is substantially normal to the plane defined by the support surface when the frame is in its expanded configuration and when the end portion of the first support linkage is anchored to the support surface.

Figure 3:
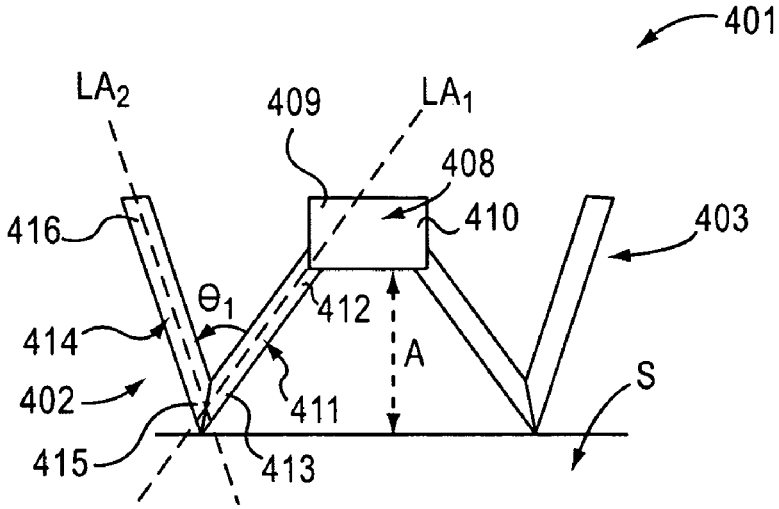
FIGS. 3 and 4 are schematic illustrations of a shelter disposed in a collapsed configuration and an expanded configuration, respectively, according to an embodiment.
Figure 4:
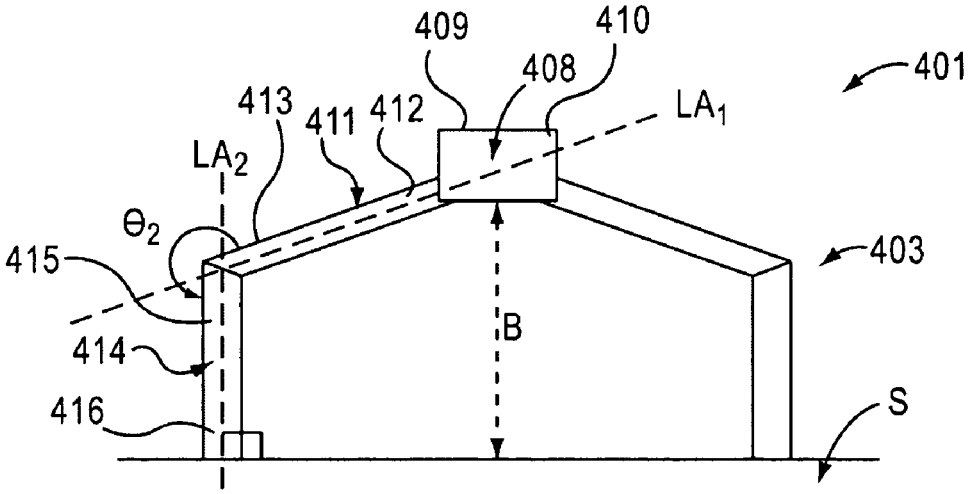

FIGS. 3 and 4 are schematic illustrations of a shelter disposed in a collapsed configuration and an expanded configuration, respectively, according to an embodiment.

The frame 401 includes a first hub 408, a first support linkage 402 and a second support linkage 403. The frame 401 excludes or is devoid of a second hub. The first support linkage 402 and the second support linkage 403 each has a collapsed configuration corresponding to the collapsed configuration of the frame 401 and an expanded configuration corresponding to the expanded configuration of the frame 401. The first hub 408 has a first end portion 409 and a second end portion 410 opposite the first end portion 409. The first support linkage 402 includes a first member 411 and a second member 414. The first member 411 has a first end portion 412 and a second end portion 413 opposite the first end portion 412. The second member 414 has a first end portion 415 and a second end portion 416 opposite the first end portion 415. The first end portion 412 of the first member 411 is movably coupled to the first end portion 409 of the first hub 408. The second end portion 413 of the first member 411 is pivotally coupled to the first end portion 415 of the second member 414. The second end portion 416 of the second member 414 can be anchored to a support surface S.

The second support linkage 403 is movably coupled to the second end portion 410 of the first hub 408. The second support linkage 403 is a mirror of the first support linkage 402 and has similar components with similar function. Thus, only the first support linkage 402 will be described in detail. In some embodiments, the second support linkage is coupled to the hub at a location separate from the first end portion of the hub and the second end portion of the hub.

The frame 401 is moveable between the collapsed configuration and the expanded configuration as shown in FIGS. 3 and 4, respectively. The frame 401 is maintained in the expanded configuration when disposed in the expanded configuration. Said another way, the frame 401 resists movement from the expanded configuration to the collapsed configuration. In some embodiments, more than two support linkages are coupled to the hub.

The frame 401 can be maintained in the expanded configuration via any suitable manner as described herein. In some embodiments, the hub can lock or prevent the first member from rotating. In some embodiments, the kinematic relationship of members can resist movement of the frame from the expanded configuration to the collapsed configuration. Said another way, the "overextension" of the first member and the second member can cause the support linkages to "bind." In some embodiments, an external member can exert a retaining force. For example, a membrane (i.e., a flexible shell) can be coupled to the frame such that it imparts a force on the frame sufficient to maintain the frame in the expanded configuration. In some embodiments, the frame is self supporting when in the expanded configuration and when anchored to a support surface. In some embodiments, the frame is self-supporting when an end portion of each support linkage is substantially fixed with respect to one another.

The frame 401 excludes a second hub different than the first hub 408. In other words, the frame 401 is devoid of a second hub different from the first hub 408. The frame 401 includes benefits of a single hub design. Specifically, no requirement exists to join two or more hubs. Additionally, the frame 401 can be devoid of a control member coupled to the first hub 408. For example, the first support linkage 402 is coupled to the first hub 408 at one and only location. In other words, the first support linkage 402 is coupled to the first hub 408 by only the first member 411 and not another member, such as, for example, a control member that can limit and/or help guide movement of the first support linkage 402 with respect to the first hub 408.

The first hub 408 is separated from a support surface S by a distance A when the frame 401 is in the collapsed configuration. The first hub 408 is separated from the support surface S by a distance B when the frame is in the collapsed configuration. The distance A is less than the distance B.

An angle $\theta_1$ formed by the an intersection between a longitudinal axis $LA_1$ defined by the first member 411 and a longitudinal axis $LA_2$ defined by the second member 414 is less than 180 degrees when the first support linkage 402 is in its collapsed configuration as shown in FIG. 3. The angle $\theta_2$ is greater than 180 degrees when the first support linkage 402 is its expanded configuration as shown in FIG. 4. In other words, the first member 411 and the second member 414 are in an "overextension" configuration as discussed above.

The longitudinal axis $LA_2$ defined by the second member 414 is substantially normal to a plane defined by the support surface S when the frame 401 is in the expanded configuration.

Figure 5:
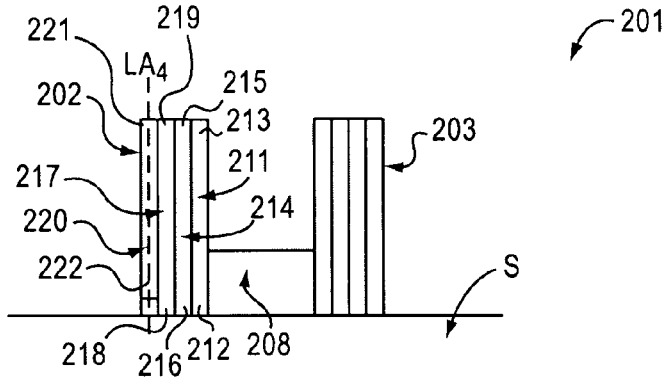
FIGS. 5-7 are schematic illustrations of a shelter disposed in a collapsed, an intermediate configuration and an expanded configuration, respectively, according to an embodiment.
Figure 6:
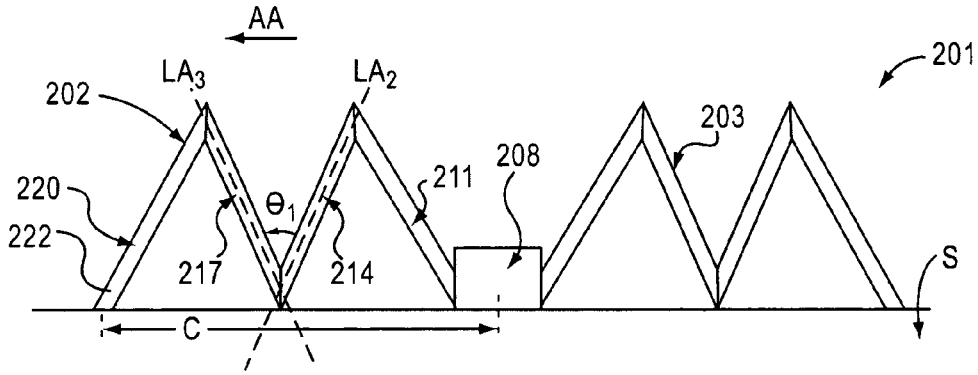
Figure 7:
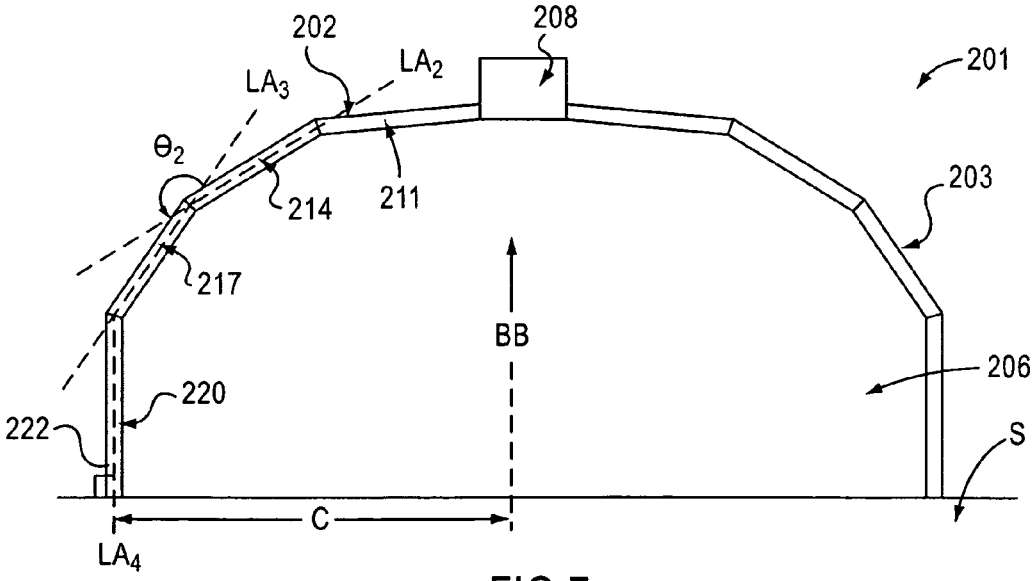

FIGS. 5-7 are schematic illustrations of a shelter disposed in a collapsed, an intermediate configuration and an expanded configuration, respectively, according to another embodiment. The intermediate configuration is between the collapsed configuration and the expanded configuration.

The frame 201 includes a first hub 208, a first support linkage 202 and a second support linkage 203. The frame 201 is devoid of a second hub. In other words, the frame 201 has a single hub (i.e., one and only one hub). The first support linkage 202 includes multiple rigid elongate members 211, 214, 217 and 220. Specifically, the first support linkage 202 includes a first member 211, a second member 214, a third member 217 and a fourth member 220. The first member 211 has a first end portion 212 and a second end portion 213 opposite the first end portion 212. The second member 214 has a first end portion 215 and a second end portion 216 opposite the first end portion 215. The third member 217 has a first end portion 218 and a second end portion 219 opposite the first end portion 218. The fourth member 220 has a first end portion 221 and a second end portion 222 opposite the first end portion 221.

The multiple rigid elongate members 211, 214, 217 and 220 are pivotally coupled together. Specifically, the first end portion 212 of the first member 211 is movably coupled to the first hub 208 at a single location. The second end portion 213 of the first member is pivotally coupled to the first end portion of 215 of the second member 214. The second end portion 216 of the second member 214 is pivotally coupled to the first end portion 218 of the third member 217. The second end portion 219 of the third member 217 is pivotally coupled to the first end portion 221 of the fourth member 220. The second end portion 222 of the fourth member 220 can be anchored to a support surface S.

The second support linkage 203 is coupled to the first hub 208. The second support linkage 203 is a mirror of the first support linkage 202 and has similar components with similar function. Thus, only the first support linkage 202 will be described in detail. In some embodiments, more than two support linkages are coupled to the hub.

The frame 201 is moveable between the collapsed configuration as shown in FIG. 5 and the expanded configuration as shown in FIG. 7. The frame 201 moves through the intermediate configuration as shown in FIG. 6 when the frame 201 is moved between the collapsed configuration and the expanded configuration. The first support linkage 202 and the second support linkage 203 each has a collapsed configuration corresponding to the collapsed configuration of the frame 201, an intermediate configuration corresponding to the intermediate configuration of the frame 201 and an expanded configuration corresponding to the expanded configuration of the frame 201.

The first support linkage 202 is independently moveable with respect to the second support linkage 203 when moved between its collapsed configuration and its intermediate configuration. In other words, the kinematic relationship of the first support linkage 202 is independent of the kinematic relationship of the second support linkage 203 when moved between its collapsed configuration and its intermediate configuration. Said another way, the first support linkage 202 can move along direction AA as shown in FIG. 6 without moving the second support linkage 203.

The first hub 208 is moveable between a first position as shown in FIGS. 5 and 6 and a second position as shown in FIG. 7. Specifically, a portion of the first hub 208 is in contact with a support surface S when the first hub 208 is in the first position. The portion of the first hub 208 is spaced apart from the support surface S when the first hub 208 is in the second position. The first hub 208 can move the frame 201 from the intermediate configuration, as shown in FIG. 6, to the expanded configuration, as shown in FIG. 7, when the first hub 208 is moved from the first position to the second position. Specifically, the first hub 208 can move the first support linkage 202 from its collapsed configuration to its expanded configuration when the first hub 208 is moved from the first position (corresponding to the collapsed configuration of the frame 201) to the second position (corresponding to the expanded configuration of the frame 201).

The first support linkage 202 and the second support linkage 203 can collectively move between their respective intermediate configuration and their respective expanded configuration when the first support linkage 202 and the second support linkage 203 are anchored to the support surface S and the first hub 208 is moved from the first position to the second position. In use, the user can anchor the second end portion 222 of the fourth member 220 to the support surface S when in the intermediate configuration such that the second end portion 222 of the fourth member 220 is separated from the first hub 208 by a lateral distance C. The user can move the frame 201 from its intermediate configuration to its expanded configuration in one operation by moving the central first hub 208 upward along direction BB. The upward movement of the central first hub 208 along direction BB coupled by the constraint of the second end portion 222 (e.g., the lower end) of the fourth member 220 causes the first support linkage 202 to unfold from its intermediate configuration, M-like shape to its expanded configuration. The second end portion 222 of the fourth member 220 is separated from the first hub 208 by the lateral distance C when the frame 201 is in its expanded configuration (see FIG. 7).

An angle (not shown) formed by an intersection between a longitudinal axis $LA_2$ defined by the second member 214 and a longitudinal axis $LA_3$ defined by the third member 217 is less than 180 degrees when the first support linkage 202 in its collapsed configuration. The angle $\theta_1$ is less that 180 degrees at one instance when the first support linkage 202 is in its intermediate configuration as shown in FIG. 6. The angle (not shown) is equal to 180 degrees at one instance as the first support linkage 202 is moved between its collapsed configuration and its expanded configuration. The angle $\theta_2$ is greater than 180 degrees when the first support linkage 202 is in its expanded configuration. In other words, the first support linkage 202 is an overextension position when in its expanded configuration. Specifically, the second member 214 and the third member 217 are overextended with respect to one another. The frame 201 can maintain itself in the expanded configuration when the first support linkage 202 is in the overextension position and when the fourth member 220 is anchored to the support surface S. In other words, the second member 214 and the third member 217 can collectively resist movement of the first support linkage 202 from the its expanded configuration to its collapsed configuration (or intermediate configuration) when the first support linkage 202 is in its expanded configuration. A longitudinal axis $LA_4$ defined by the fourth member 220 is substantially normal to a plane defined by the support surface S when the first support linkage 202 is in the expanded configuration.

As shown in FIG. 5, the first hub 208 can assist the frame 201 in maintaining its collapsed configuration such that when a portion of the first hub 201 is in contact with the support surface S the longitudinal axis $LA_4$ of the fourth member 220 is substantially normal to the support surface S. In other words, the first hub 208 can maintain the first support linkage 202 in the collapsed configuration without external support (e.g., a strap about the support linkages or the cooperation of multiple users) such that the longitudinal axis $LA_4$ defined by the fourth member 220 is substantially normal to the plane defined by the support surface S.

In some embodiments, the first hub can include a locking member having a first position and a second position different than the first position. The locking member can inhibit movement of at least the first support linkage from the expanded configuration to the collapsed configuration (and intermediate configuration) when the locking member is in the second position and the frame 201 is in the expanded configuration. Said differently, the locking member can maintain the frame in its expanded configuration when the locking member is in its second position. In other words, the locking member can prevent at least one of the first support linkage or the second support linkage from pivoting relative to the first hub when the locking member is in its second position. In some embodiments, the locking member can inhibit movement of the first support linkage from the collapsed configuration to the expanded configuration when the locking member is in the second position and the first support linkage is in the collapsed configuration. In some embodiments, the locking member can move from its first position to its second position as the first hub is moved from its first position to its second position (e.g., corresponding to when the frame is moved from its collapsed configuration to its expanded configuration).

As shown in FIG. 7, the multiple support linkages 202 and 203 are collectively moveable between a first configuration and a second configuration when the first support linkage 202 is moved from its collapsed configuration to its expanded configuration. The first hub 208 and the multiple support linkages 202 and 203 collectively form an interior region 206 when the multiple support linkages 202 and 203 are in their expanded configuration. In some embodiments, a flexible shell (not shown) can be coupled to the multiple support linkages outside of the interior region. The flexible shell can resist movement of the support linkages when the first support linkage is in the expanded configuration. In other words, the flexible shell can resist movement of the multiple support linkages from the expanded configuration to the collapsed configuration (and intermediate configuration) when the first support linkage is in the expanded configuration. Said another way, in some embodiments, the flexible shell can exert a force on the multiple support linkages when the first support linkage is in the expanded configuration such that the movement of the support linkage from its expanded configuration to its collapsed configuration is resisted. The flexible shell can be, for example, a membrane, tent fabric covering, etc.

In some embodiments, the flexible shell can elastically deform when the first support linkage moves between its collapsed configuration and its expanded configuration such that the first support linkage and, thus, the frame is maintained in its expanded configuration. In other words, the flexible shell can elastically deform when the first support linkage is moved between the collapsed configuration and the expanded configuration such that the flexible shell maintains the first support linkage in its expanded configuration. In some embodiments, the flexible shell can resist outward expansion of the first support linkage and the second support linkage when the first support linkage is in its expanded configuration.

In some embodiments, the frame is a tent frame and the flexible shell is a tent cover. In some embodiments, the frame is a portion of a collapsible portable shelter and the flexible shell is a canopy.

Figure 8:
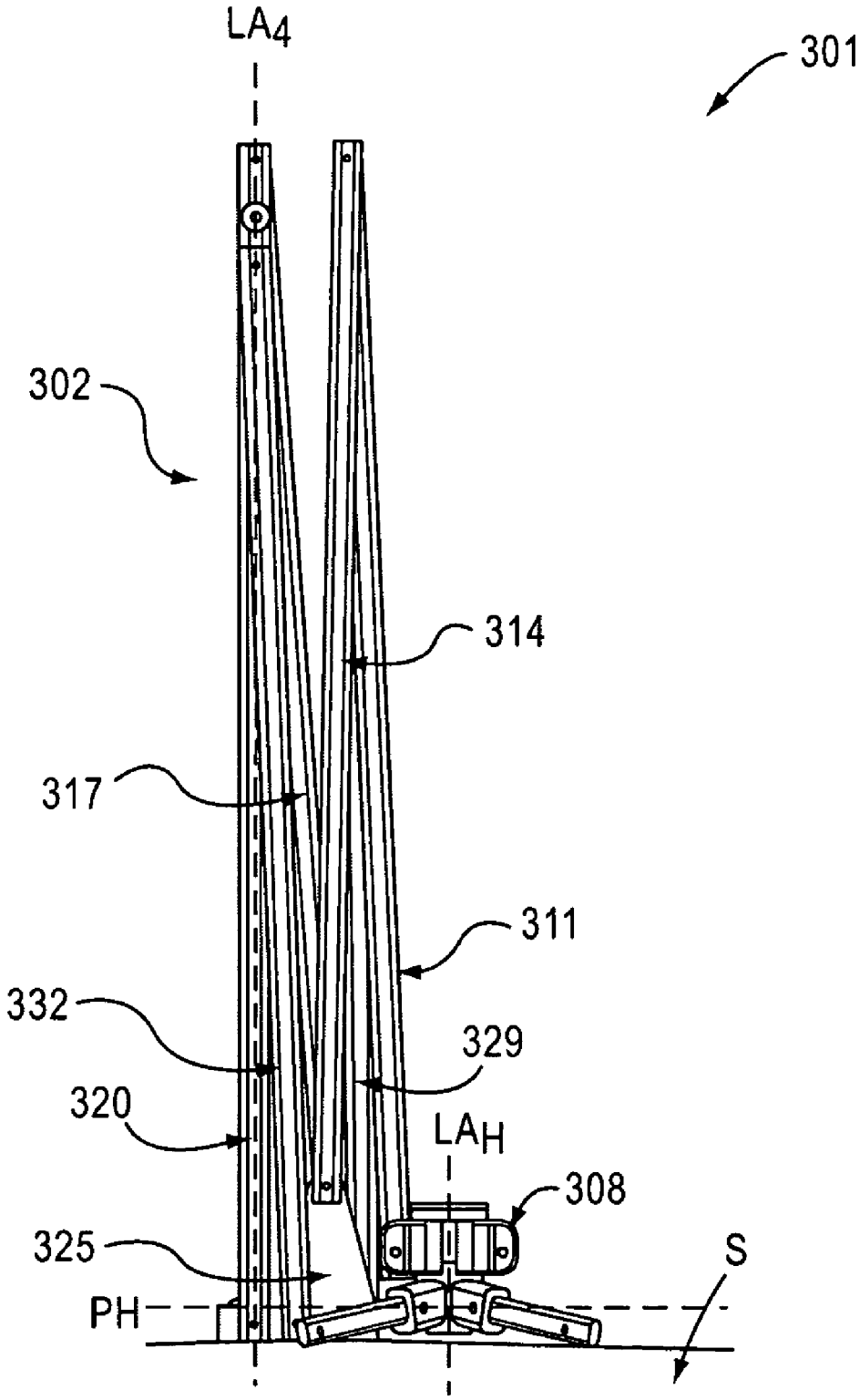
FIG. 8 is a side view of a portion of a frame disposed in a collapsed configuration according to an embodiment.
Figure 9:
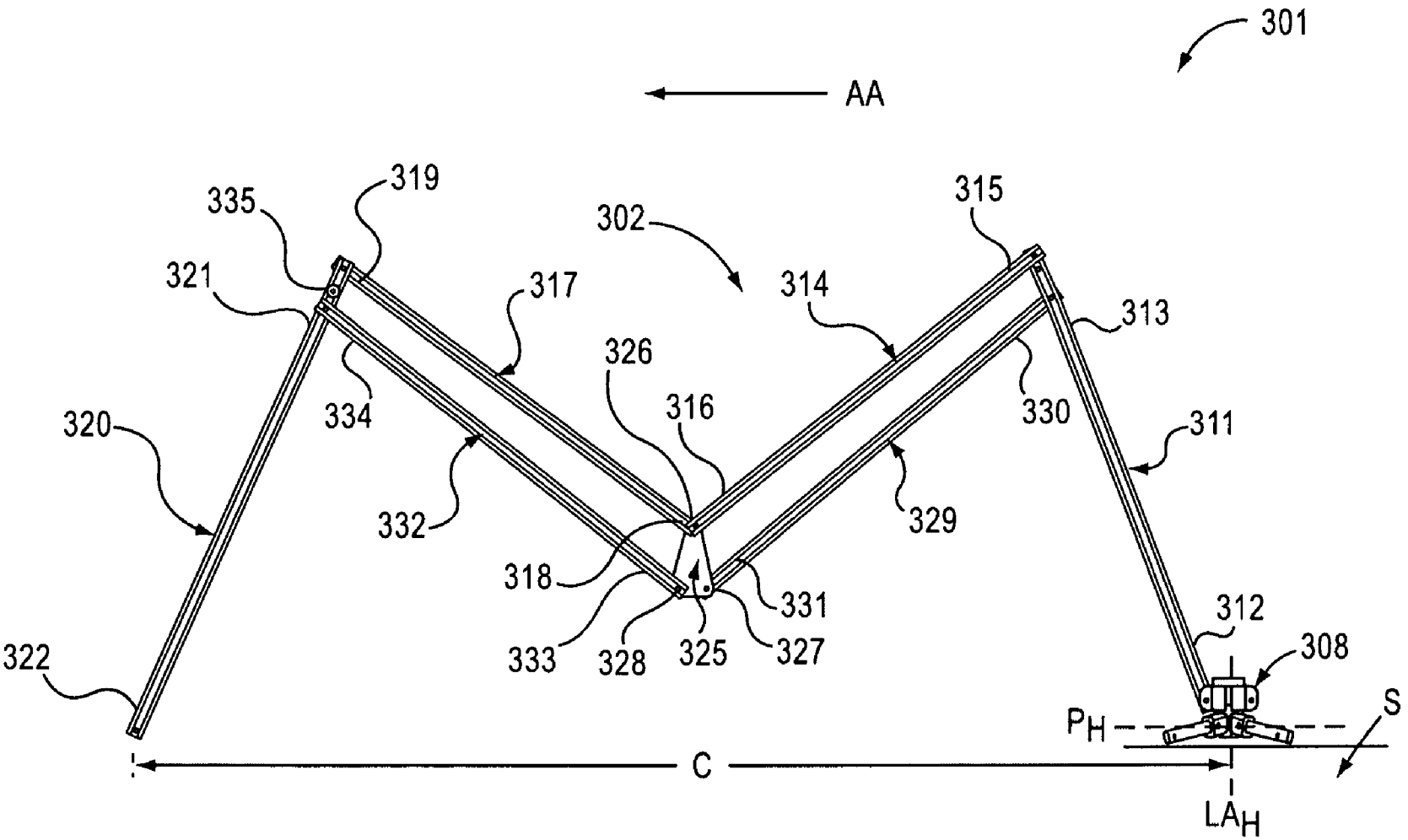
FIGS. 9-11 are side views of the portion of the frame of FIG. 8 disposed in various positions of an intermediate configuration.
Figure 10:
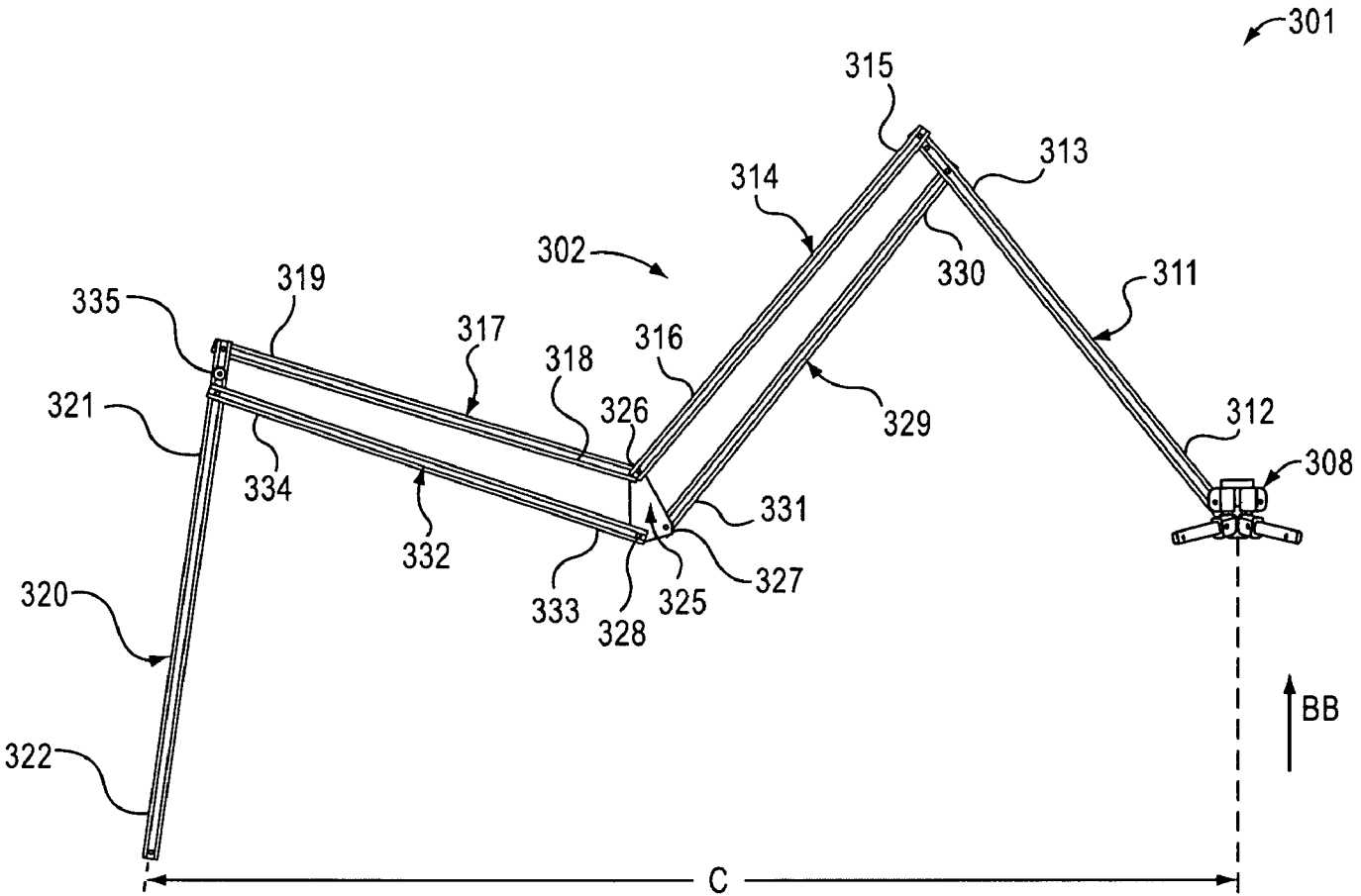
Figure 11:
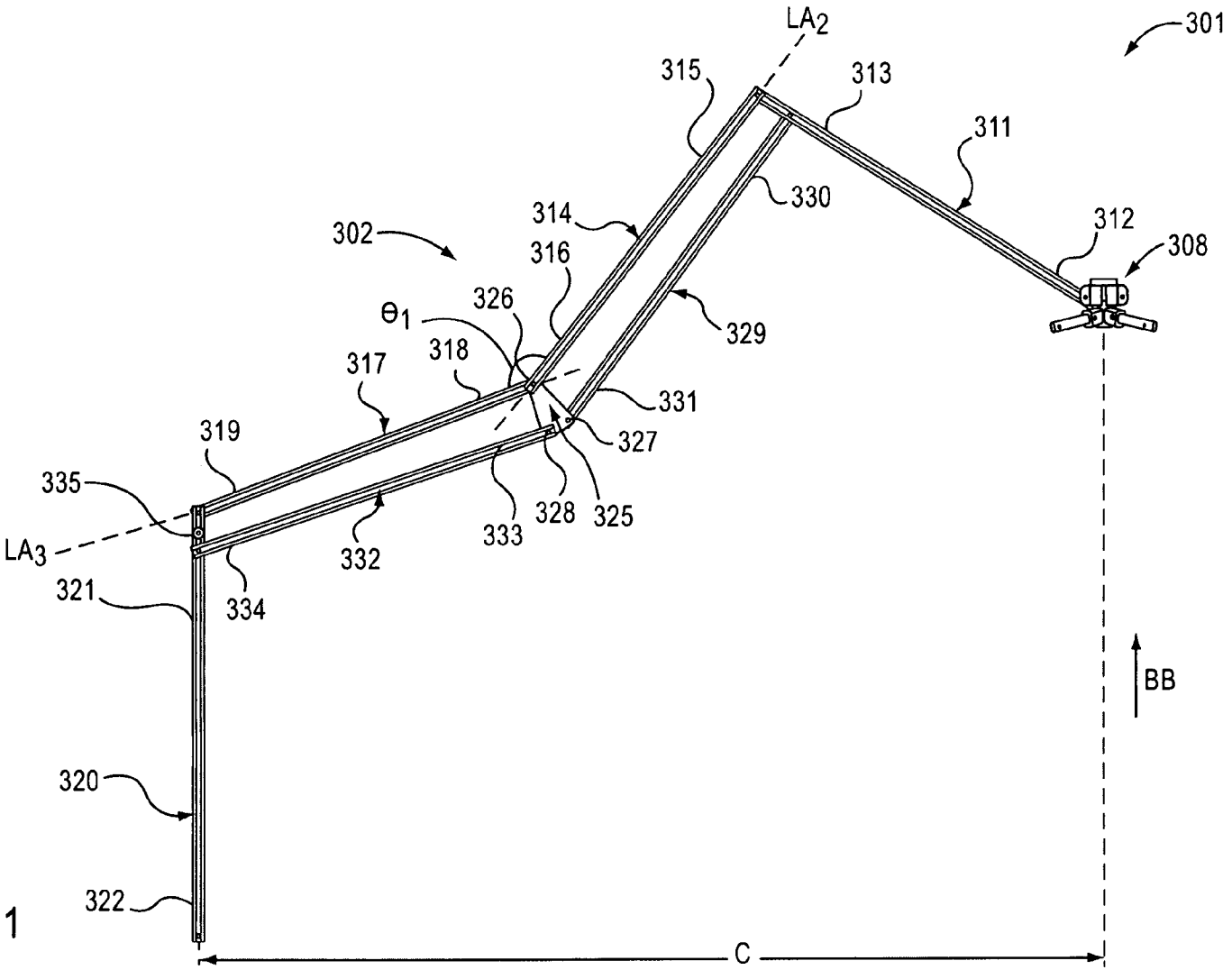
Figure 12:
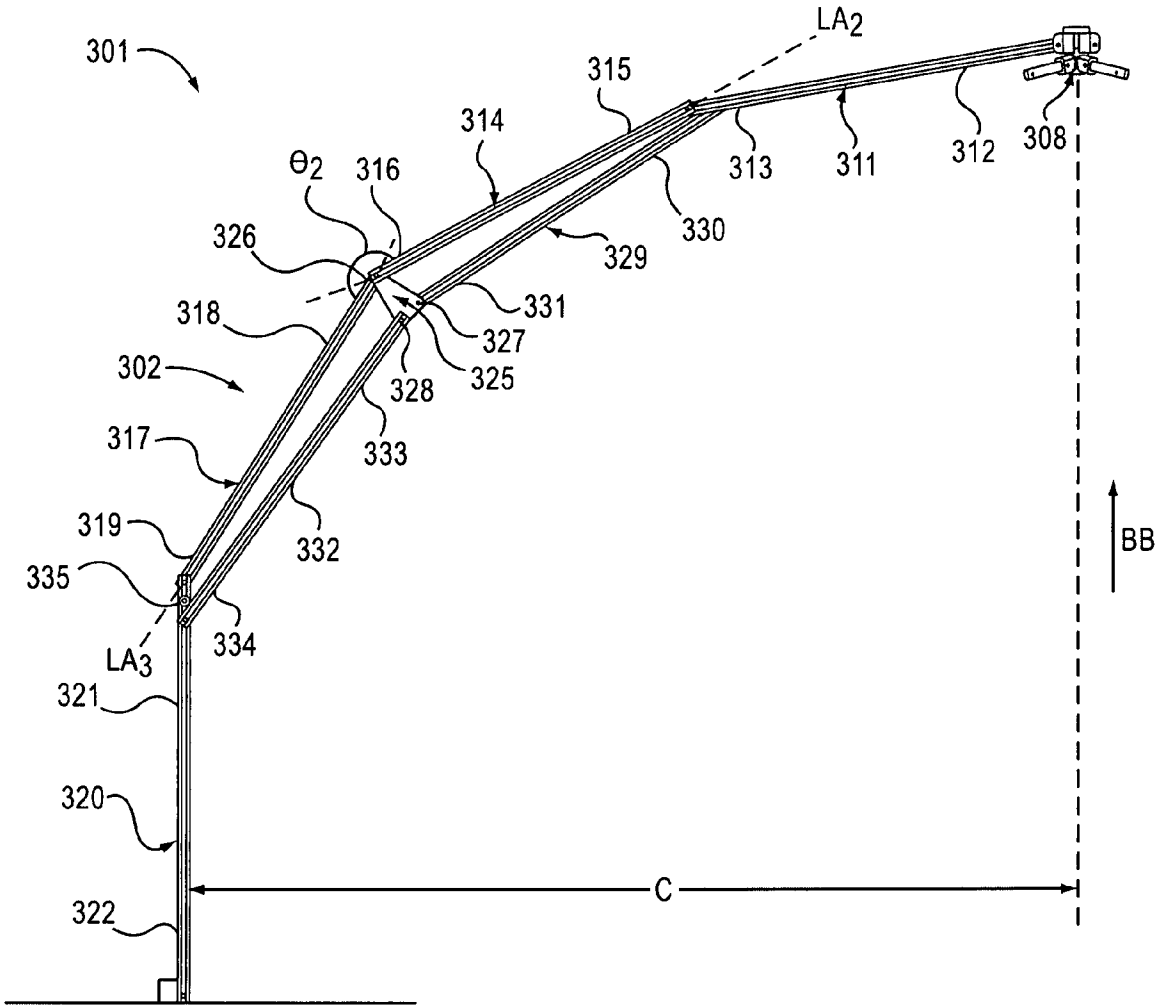
FIG. 12 is a side view of the portion of the frame of FIG. 8 disposed in an expanded configuration.

FIG. 8 is a side view of a portion of a frame disposed in a collapsed configuration according to an embodiment. FIGS. 9-11 are side views of the portion of the frame of FIG. 8 disposed in various positions of an intermediate configuration. FIG. 12 is a side view of the portion of the frame of FIG. 5 disposed in an expanded configuration. The intermediate configuration is between the collapsed configuration and the expanded configuration. The collapsible shelter 301 is portable when in the collapsed configuration.

Figure 21:
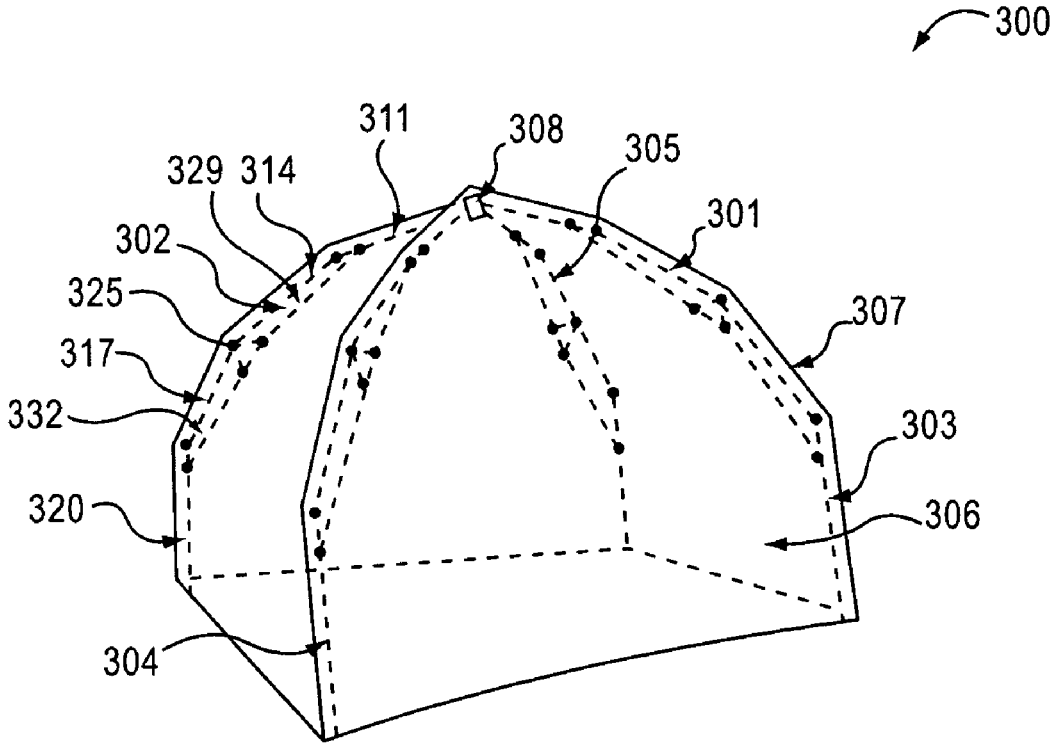
FIG. 21 is a perspective view of a shelter.

The frame 301 includes a first hub 308 and a first support linkage 302 as shown in FIGS. 8-12. The frame 301 includes a second support linkage shown in FIG. 13 and a third support linkage 304 and a fourth support linkage 305 as shown in FIG. 21. The first hub 308 is movably coupled to each of the support linkages 302, 303, 304 and 305. The first hub 308 is substantially at a center location of the frame 301. In other words, the first hub 308 is at a center location with respect to the support linkages 302, 303, 304 and 305, collectively.

The first support linkage 302 includes multiple rigid elongate members 311, 314, 317 and 320. Specifically, the first support linkage 302 includes a first member 311, a second member 314, a third member 317 and a fourth member 320. The first member 311 has a first end portion 312 and a second end portion 313 opposite the first end portion 312. The second member 214 has a first end portion 315 and a second end portion 316 opposite the first end portion 315. The third member 317 has a first end portion 318 and a second end portion 319 opposite the first end portion 318. The fourth member 320 has a first end portion 321 and a second end portion 322 opposite the first end portion 321.

The multiple rigid elongate members 311, 314, 317 and 320 are pivotally coupled together. Specifically, the first end portion 312 of the first member 311 is movably coupled to the first hub 308 at a single (i.e., one and only location). The second end portion 313 of the first member is pivotally coupled to the first end portion of 315 of the second member 314. The second end portion 316 of the second member 314 is pivotally coupled to the first end portion 318 of the third member 317. The second end portion 319 of the third member 317 is pivotally coupled to the first end portion 321 of the fourth member 320. The second end portion 322 of the fourth member 320 can be anchored to a support surface S.

The second member 314 is pivotally coupled to the third member 317 via a coupling member 325. The coupling member 325 has a first portion 326, a second portion 327 and a third portion 328. Specifically, the second end portion 316 of the second member 314 is pivotally coupled to the first portion 326 of the coupling member 325. The first end portion 318 of the third member 317 is also pivotally coupled to the first end portion 326 of the coupling member 325. The first support linkage 302 includes a first control member 329 having a first end portion 330 and a second end portion 331 opposite the first end portion 330. The first end portion 330 of the first control member 329 is pivotally coupled to the first member 311. The second end portion 331 of the first control member 329 is pivotally coupled to the second portion 327 of the coupling member 325. The first support linkage 302 includes a second control member 332 having a first end portion 333 and a second end portion 334 opposite the first end portion 333. The first end portion 333 of the second control member 332 is pivotally coupled to the third portion 328 of the coupling member 325. The second end portion 334 of the second control member 332 is pivotally coupled to the fourth member 320. In this embodiment, the coupling member 325 is substantially triangular in shape, in other embodiments, the coupling member can be any shape, including for example, a square shape, a circular shape, an ovular shape, a rectangular shape, etc. In some embodiments, second end portion of the second member can be pivotally coupled to a location of the coupling member different from the location where the first end portion of the third member is pivotally coupled to the coupling member.

In the illustrated embodiment, any member that is pivotally coupled to another member can be coupled for example via a nut and bolt, a rivet, or a pin that extends through at least a portion of one member and through at least a portion of the other member. In alternative embodiments, other connection mechanisms, such as, for example, brads, hinges, or any other type of pivoting joints, are used to couple a member to another member. In some embodiments, a first member can be adjacent to or in contact with a second member when the first member is coupled to the second member along a side of the second member.

In some embodiments, the members are coupled to the coupling member via an adhesive, such as glue. In alternative embodiments, the members are coupled to the coupling member via a screw, a rivet, a pin, or any other coupling mechanism. In a further alternative embodiment, the members are fit into openings of the coupling member, respectively, and are retained via friction. In an alternative embodiment, the first support linkage of the frame does not include a coupling member. Rather, the second member is pivotally coupled to the third member of via a rivet, a nut and bolt, a pin, or any other type of pivoting joint.

As best shown in FIGS. 9-12, the first support linkage 302 excludes a control member coupled to the first hub 308. Specifically, the first support linkage 302 is devoid of a control member coupled to the first hub 308 and the first support linkage 302.

Figure 13:
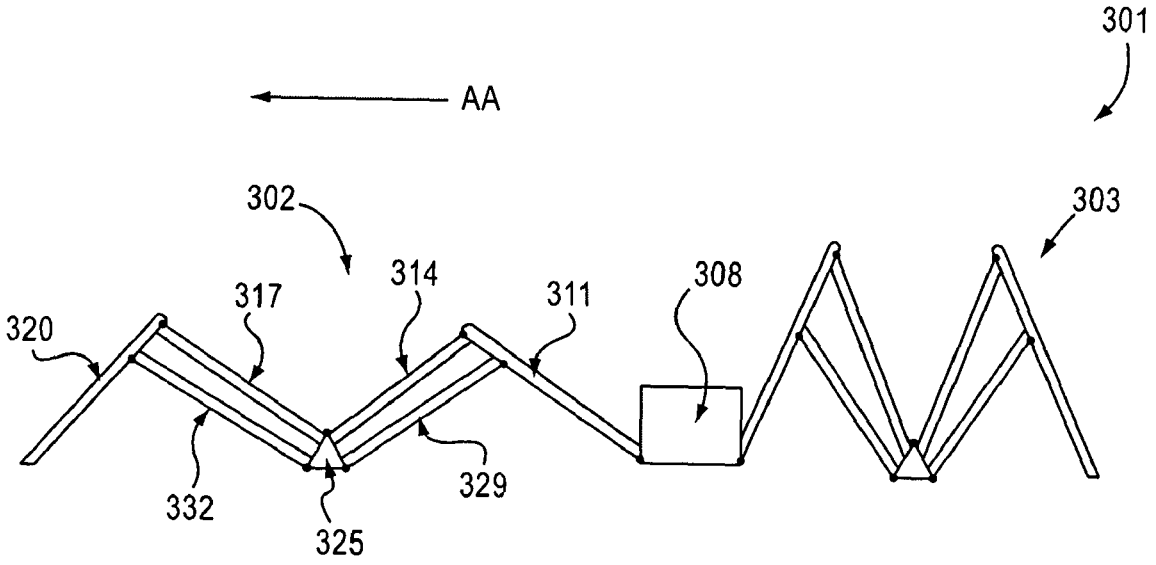
FIG. 13 is a side view of a portion of the frame.

The second support linkage 303 is movably coupled to the first hub 308 as shown in FIG. 13. The third support linkage 304 and the fourth support linkage 305 are movably coupled to the first hub 308 as shown in FIG. 21. The second support linkage 303, the third support linkage 304 and the fourth support linkage 305 are a mirror of the first support linkage 302 and have similar components with similar function. Thus, only the first support linkage 302 will be described in detail. In some embodiments, more or less than four support linkages are coupled to the first hub.

The frame 301 is moveable between the collapsed configuration as shown in FIG. 8 and the expanded configuration as shown in FIG. 12. The frame 301 moves through the intermediate configuration as shown in FIGS. 9-11 when the frame 301 is moved between the collapsed configuration and the expanded configuration. The first support linkage 302 and the second support linkage 303 each has a collapsed configuration corresponding to the collapsed configuration of the frame 301, an intermediate configuration corresponding to the intermediate configuration of the frame 301 and an expanded configuration corresponding to the expanded configuration of the frame 301.

As shown in FIGS. 8 and 17-21, the first hub 308 can maintain the frame 301 in its collapsed configuration such that when a portion of the first hub 301 is in contact with the support surface S the longitudinal axis $LA_4$ of the fourth member 320 is substantially normal to the support surface S. In other words, the first hub 308 can maintain the first support linkage 302 in the collapsed configuration without external support (e.g., a strap about the support linkages or the cooperation of multiple users) such that the longitudinal axis $LA_4$ defined by the fourth member 320 is substantially normal to the plane defined by the support surface S.

The first hub 308 can maintain its position relative to the support surface S when each support linkage is independently moved from its collapsed configuration to its intermediate configuration. For example, the frame 301 can be setup or moved from its collapsed configuration to its intermediate configuration via a single user. Specifically, the single user can move the first support linkage 302 from its collapsed configuration to its intermediate configuration shown in FIG. 9 without moving the first hub 308 or the other support linkages 303, 304 and 305. In other words, a longitudinal axis $LA_H$ defined by the first hub 308 remains substantially normal to the plane defined by the support surface S as the first support linkage 302 is moved from its collapsed configuration as shown in FIG. 8 to its intermediate configuration as shown in FIG. 9. Said another way, a plane $P_H$ defined by the first hub 308 remains substantially parallel to the plane defined by the support surface S as the first support linkage 302 is moved from its collapsed configuration as shown in FIG. 8 to its intermediate configuration as shown in FIG. 9.

Figure 14:
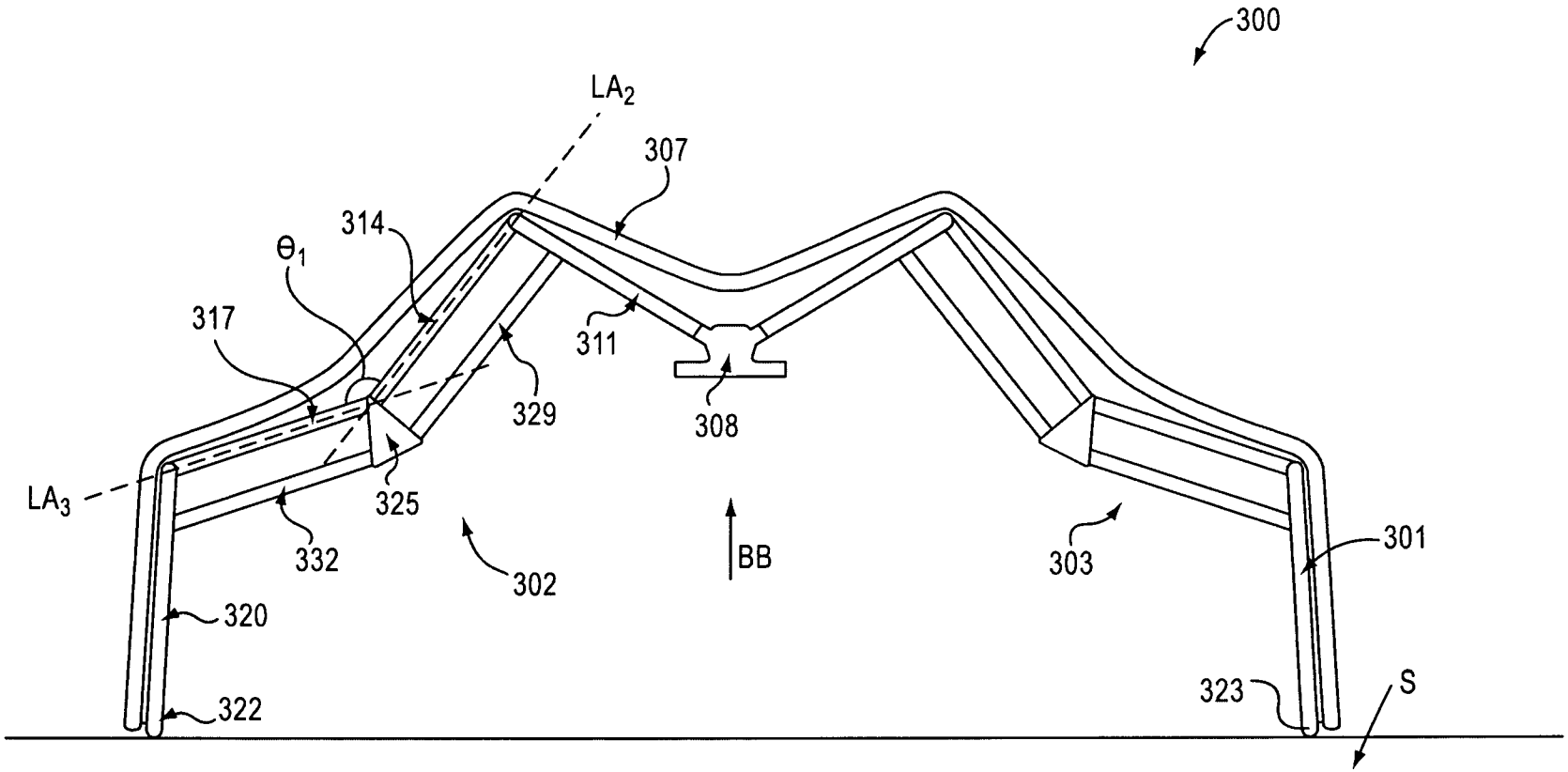
FIGS. 14-16 are cross-sectional views of a portion of a shelter disposed in a first configuration, a second configuration and a third configuration, respectively.
Figure 15:
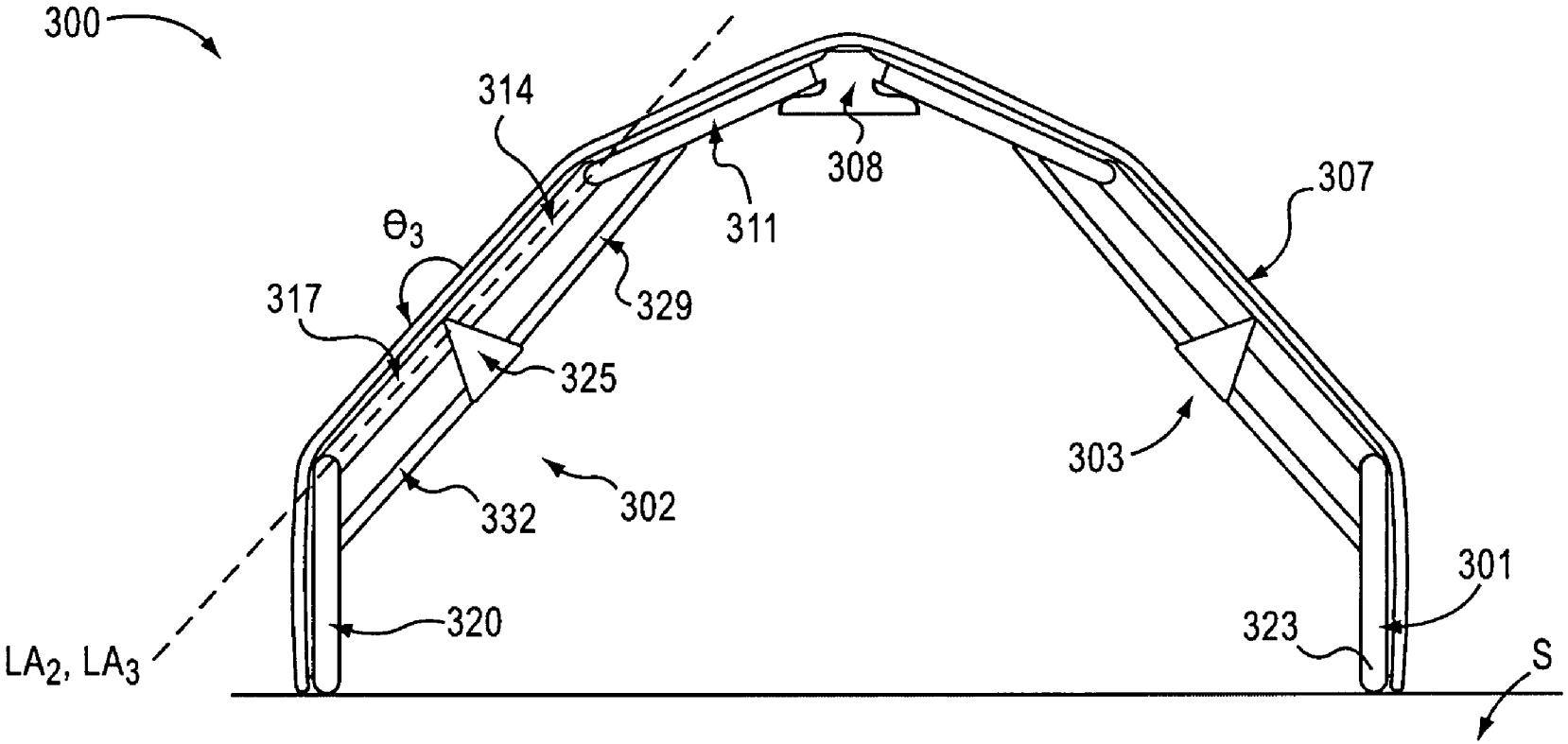
Figure 16:
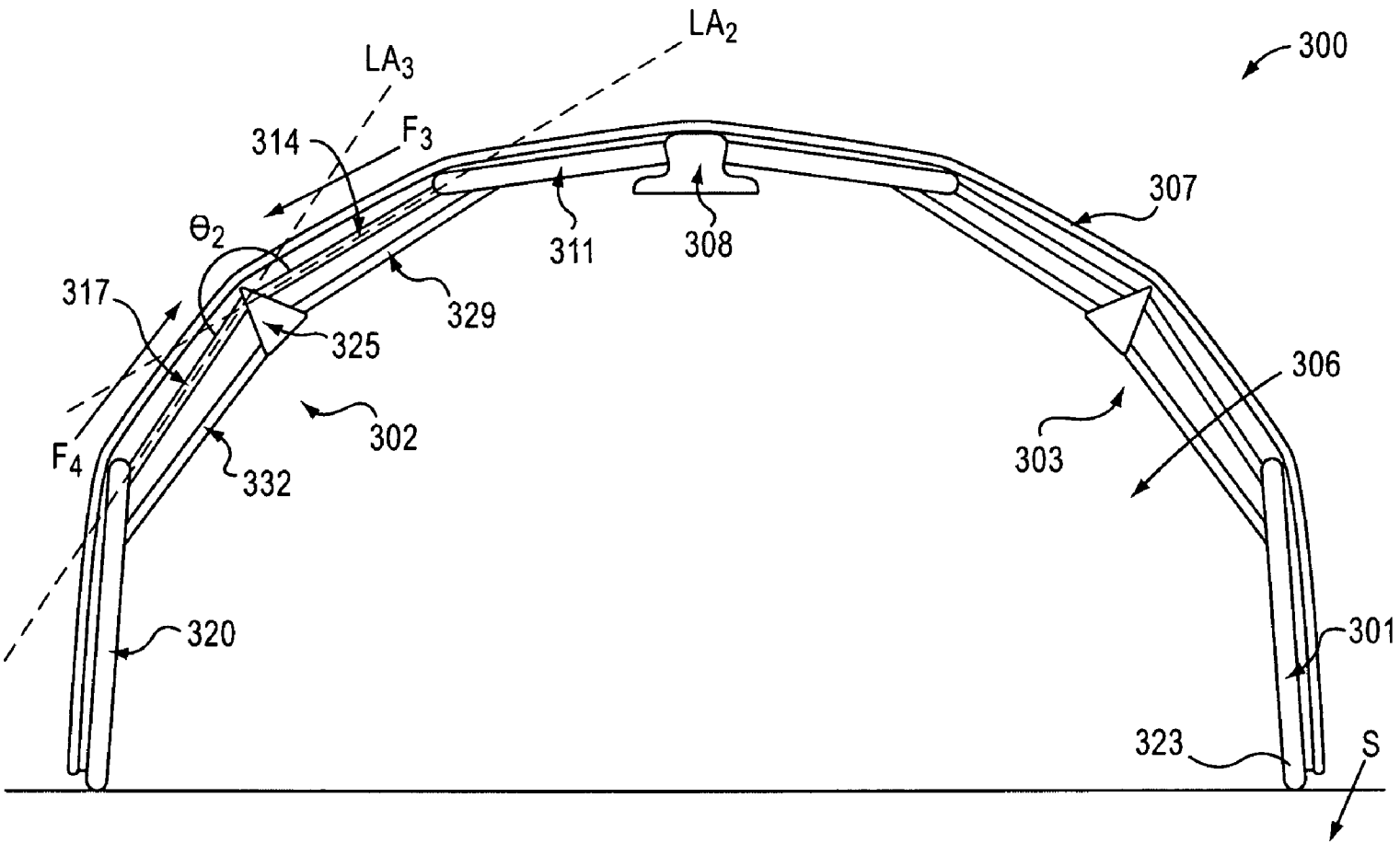
Figure 19:
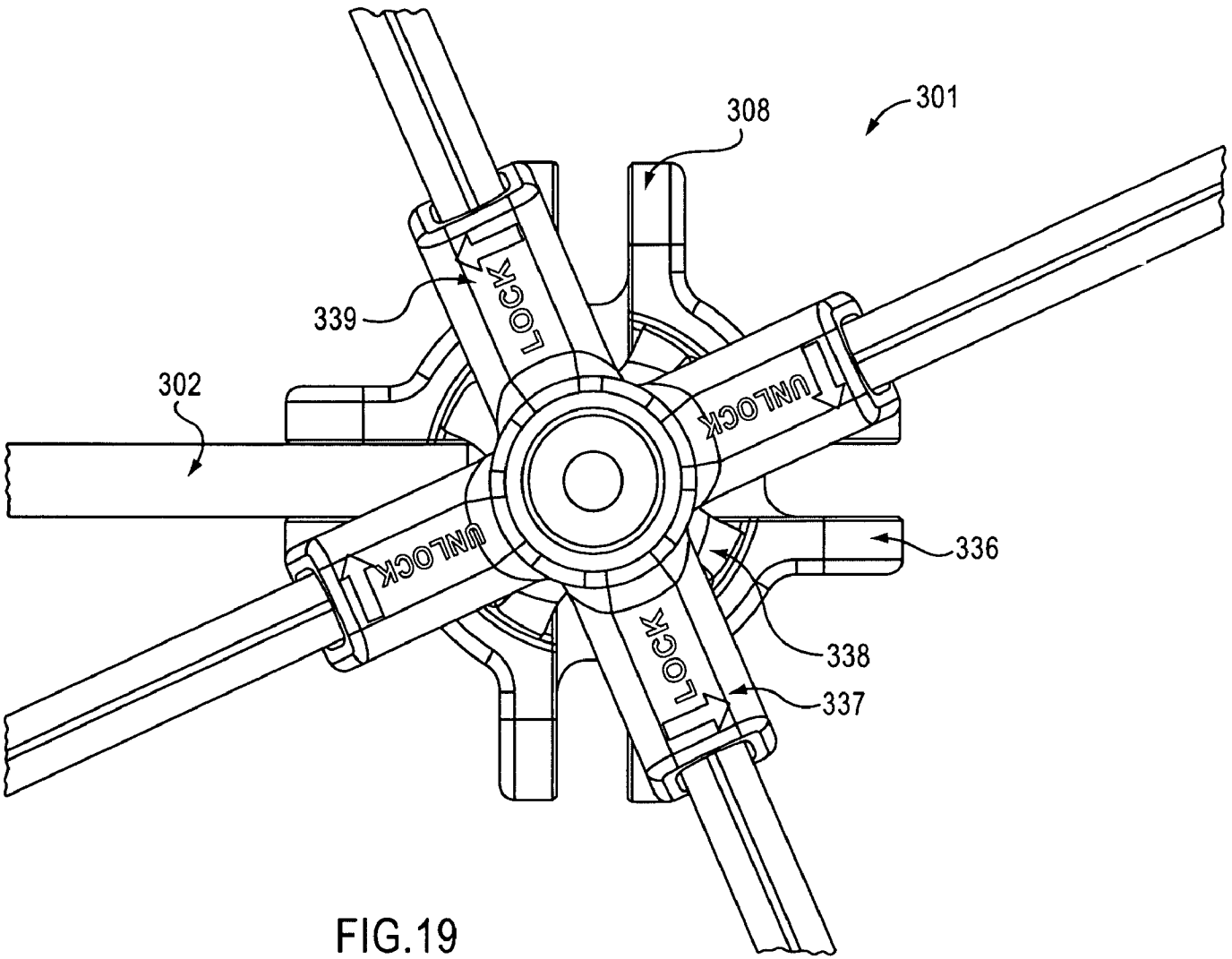
FIGS. 19 and 20 are bottom views of the hub of FIG. 14.
Figure 20:
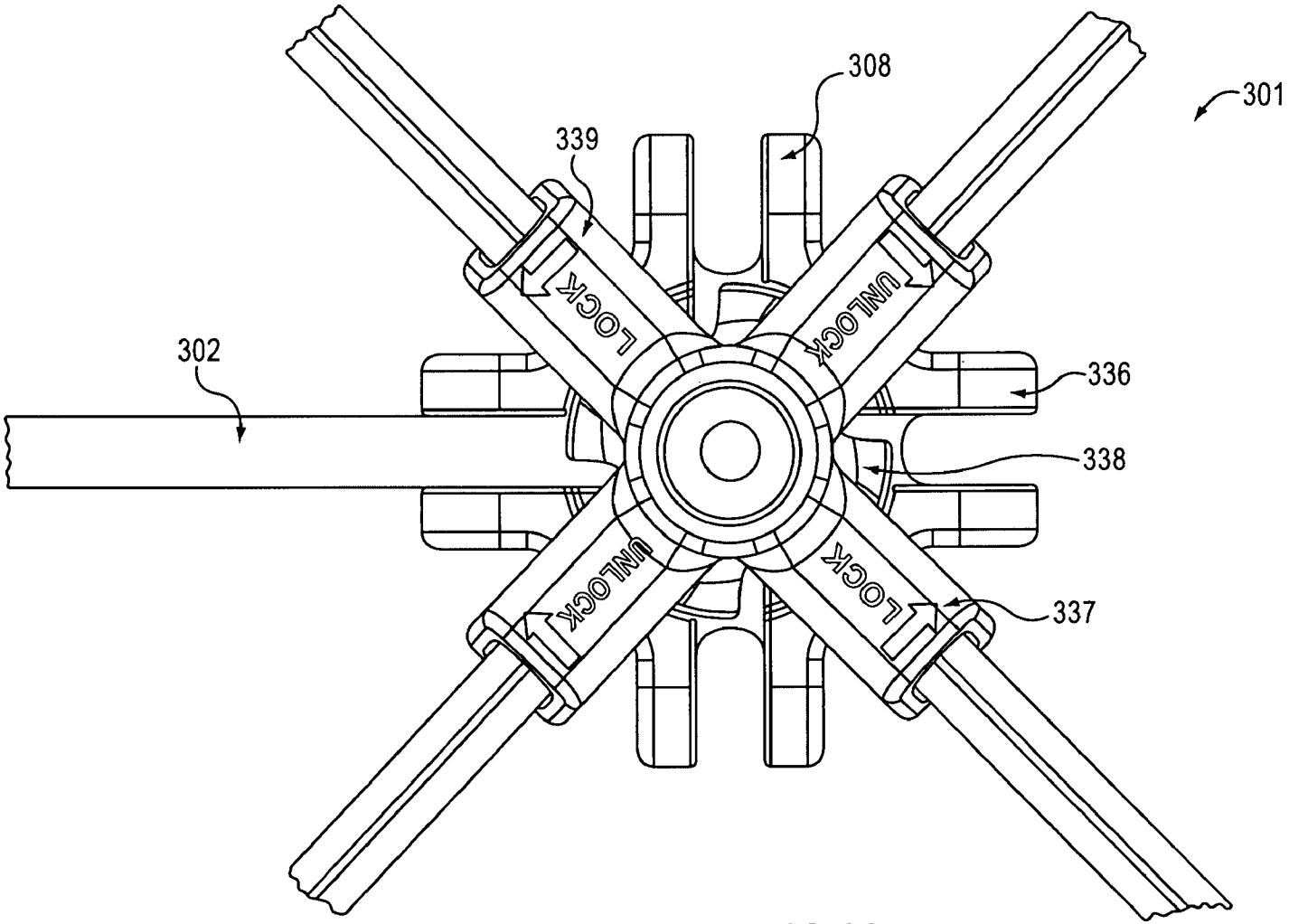

The frame 301 is maintained in the expanded configuration when disposed in the expanded configuration. Said another way, the frame 301 resists movement from the expanded configuration to the collapsed configuration. The frame 301 can be maintained in the expanded configuration via any suitable manner as described herein. As shown in FIGS. 19-21, the first hub 308 can lock or prevent the first member 311 from rotating with respect to the first hub 308 as discussed below. As shown in FIG. 12, the kinematic relationship of the first support linkage 302 can resist movement of the frame 301 from the expanded configuration to the collapsed configuration. Said another way, the "overextension" of the second member 314 and the third member 317 can cause the first support linkage 302 to "bind" as discussed below. As shown in FIGS. 14-16, an external member 307 (also referred to herein as a "flexible shell" or a "membrane") exerts a retaining force on the frame 301. For example, the membrane 307 is coupled to the frame 301 such that it imparts a force on the frame sufficient to maintain the frame 301 in the expanded configuration as discussed below. The frame 301 is also self-supporting when in the expanded configuration and when a distance between an end portion of the first support linkage 301 and the an end portion of the second support linkage 303 is substantially constant. For example, the frame 301 is self-supporting when in the expanded configuration and when anchored to the support surface S. Specifically, when the second end portion 322 of the fourth member 320 is anchored to the support surface S and second support linkage 303 is anchored to the support surface S, the frame 301 can remain in its expanded configuration when disposed in its expanded configuration.

The frame 301 has a single hub 308 (i.e., one and only one hub). Said another way, the frame 301 excludes a second hub different than the first hub 308. In other words, the frame 301 is devoid of a second hub different from the first hub 308. The frame 301 includes benefits of a single hub design. Specifically, no requirement exists to join two or more hubs. Additionally, the frame 301 is devoid of a control member coupled to the first hub 308.

The first support linkage 302 moveable with respect to the first hub 308 when moved between its collapsed configuration and its intermediate configuration. Specifically, the first support linkage 302 can be moved from its collapsed configuration as shown in FIG. 8 to a first position within its intermediated configuration as shown in FIG. 9 via a movement of the first support linkage 302 along direction AA.

The first hub 308 is moveable between a first position as shown in FIG. 9 and a second position as shown in FIG. 12. Specifically, a portion of the first hub 308 is in contact with a support surface S when the first hub 308 is in the first position. This portion of the first hub 308 is spaced apart from the support surface S when the first hub 308 is in the second position. The first hub 308 can move the frame 301 from its collapsed configuration to its expanded configuration when the first hub 308 is moved from the first position to the second position. Specifically, the first hub 308 can move the first support linkage 302 from its collapsed configuration to its expanded configuration when the first hub 308 is moved from the first position (corresponding to the collapsed configuration of the frame 301) to the second position (corresponding to the expanded configuration of the frame 301).

The first support linkage 302 can move between its intermediate configuration and its expanded configuration when the first support linkage 302 is anchored to the support surface S and the first hub 308 is moved from the first position to the second position. In use, the user can anchor the second end portion 322 of the fourth member 320 to the support surface S when in the intermediate configuration such that the second end portion 322 of the fourth member 320 is separated from the first hub 208 by a lateral distance C. The user can move the frame 301 from its collapsed configuration to its expanded configuration in one operation by moving the central first hub 308 upward along direction BB as shown in FIGS. 10-12. The upward movement of the central first hub 308 along direction BB and the constraint of the second end portion 322 (e.g., the lower end) of the fourth member 320 causes the first support linkage 302 to unfold from its intermediate configuration, M-like shape to its expanded configuration. The second end portion 322 of the fourth member 320 is separated from the first hub 308 by the lateral distance C when the frame 301 is in its expanded configuration.

An angle (not shown in FIG. 8) formed by an intersection between a longitudinal axis $LA_2$ defined by the second member 314 and a longitudinal axis $LA_3$ defined by the third member 317 is less than 180 degrees when the first support linkage 302 in its collapsed configuration. The angle $\theta_1$ is less that 180 degrees at one instance when the first support linkage 302 is in its intermediate configuration as shown in FIG. 11. The angle $\theta_2$ is greater than 180 degrees when the first support linkage 302 is in its expanded configuration as shown in FIG. 12. In other words, the first support linkage 302 is an overextension position. Specifically, the second member 314 and the third member 317 are overextended with respect to one another. The frame 301 can maintain itself in the expanded configuration when the frame 301 is in the overextension position and when the fourth member 320 is anchored to the support surface S. In other words, the second member 314 and the third member 317 can collectively resist movement of the first support linkage 302 from the its expanded configuration to its collapsed configuration (and intermediate configuration) when the first support linkage 302 is in its expanded configuration. A longitudinal axis $LA_4$ defined by the fourth member 320 is substantially normal to a plane defined by the support surface S when the first support linkage 302 is in the expanded configuration. The angle (not shown) is equal to 180 degrees at one instance when the first support linkage 202 is moved between its collapsed configuration and its expanded configuration, which is discussed below.

As discussed above, the second end portion 313 of the first member 311 is pivotally coupled to the first end portion 315 of the second member 314. When moving the shelter 300 from its expanded configuration to its collapsed configuration, the first member 311 rotates with respect to the second member 314 before the "overextension" of the second member 314 and the third member 317 becomes an "underextension" of the second member 314 and the third member 317. Said differently, the joint at which the first member 311 and second member 314 are coupled moves outwardly before the joint at which the second member 314 and the third member 317 are coupled moves inwardly. Such movements can include non-uniform movements including an increased movement similar to a "pop" when the joint at first member 311 and second member 314 moves from "overextension" to "underextension."

As shown in FIG. 12, the fourth member 320 has a protrusion 335 that can engage the second end portion 334 of the second control member 332 when the frame 301 is in the expanded configuration to limit movement of the second control member 332 relative to the fourth member 320. Accordingly, the protrusion 335 inhibits outward movement of the first support linkage 302 beyond its expanded configuration.

FIG. 13 is a side view of a portion of the frame 301. As discussed above, the first support linkage 302 is devoid of a control member coupled to the first hub 308 and the first support linkage 302. The lack of control member permits independent movement of the first support linkage 302 with respect to the second support linkage 303. Specifically, the first support linkage 302 is independently moveable with respect to the second support linkage 303 when moved between its collapsed configuration and its intermediate configuration. In other words, the kinematic relationship of the first support linkage 302 is independent of the kinematic relationship of the second support linkage 303 when moved between its collapsed configuration and its intermediate configuration. Said another way, the first support linkage 302 can move along direction AA as shown in FIG. 13 without moving the second support linkage 303.

FIGS. 14-16 are cross-sectional views of a portion of a shelter 300 disposed in a first configuration, a second configuration and a third configuration, respectively. The third configuration of the shelter 300 as shown in FIG. 16 corresponds to the expanded configuration of the first support linkage 302.

The membrane 307, the first support linkage 302 and the second support linkage 303 collectively form an interior region 306 when the shelter 300 is in the third configuration. In some embodiments, the interior region is collectively defined by the membrane, the first support linkage, the second support linkage and additional support linkage(s) (not shown). The membrane 307 can be, for example, a tent fabric covering, a tarp, etc.

The membrane 307 is coupled to the second end portion 322 of the fourth member 320 and coupled to an end portion 323 of the second support linkage 303. The membrane 307 is not taut (e.g., loose) when the shelter 300 is in the first configuration as shown in FIG. 14. The membrane 307 becomes elastically deformed when the shelter 300 is moved from the first configuration to the third configuration due to outward movement of first support linkage 302 and the second support linkage 303. Said another way, the membrane 307 has a first length when the shelter 300 is in the first configuration. The membrane 307 has a second length when shelter 300 is in the third configuration. The second length is greater (i.e., larger) than the first length. In some embodiments, the membrane is coupled to the frame exterior of an interior region defined by the frame.

The angle $\theta_1$ formed by the intersection between the longitudinal axis $LA_2$ defined by the second member 314 and the longitudinal axis $LA_3$ defined by the third member 317 is less than 180 degrees ($\pi$ radian) when the shelter 300 is in its first configuration such that the membrane 307 is deformed by a first amount as shown in FIG. 14. The angle $\theta_2$ is greater than 180 degrees when the shelter 300 is in the third configuration (i.e., its expanded configuration) such that the membrane 307 is deformed by a second amount. The angle $\theta_3$ is equal to 180 degrees when the shelter 300 is in the second configuration such that the membrane 307 is elastically deformed by a third amount greater than the first amount and the second amount.

As shown in FIG. 16, the membrane 307 exerts a force on the frame 301 along direction $F_3$ and a force on the frame 301 along direction $F_4$. The directions $F_3$ and $F_4$ are substantially parallel to the longitudinal axis $LA_2$ of the second member 314 and the longitudinal axis $LA_3$ of the third member 317, respectively. Specifically, the force along direction $F_3$ and the force along direction $F_4$ intersect at or near the coupling of second end portion 316 of the second member 314 and the first end portion 318 of the third member 317 to maintain their respective position and resist movement of the frame 301 from the expanded configuration to the collapsed configuration. Said differently, the force along direction $F_3$ and the force along direction $F_4$ collectively resist rotational movement of the second member 314 and the third member 317 towards a 180 degree (π radian) angle formed by the longitudinal axis $LA_2$ of the second member 314 and the longitudinal axis $LA_3$ of the second member 317 as shown in FIG. 15. Although the forces on the joint formed by the coupling of the second end portion 316 of the second member 314 and the first end portion 318 of the third member 317 are described in detail, it should be understood that similar forces are acting upon each joint formed by a coupling of two or more components such that the two or more components resist movement from the expanded configuration to the collapsed configuration when the frame 301 is in the expanded configuration.

The frame 301 can deform the membrane 307 by a first amount when the frame 301 is in its collapsed configuration. The frame 301 can deform the membrane 307 by a second amount when the frame 301 is in its expanded configuration. The frame 301 can deform the membrane 307 by a third amount when the frame 301 is in its intermediate configuration. The third amount is greater than the first amount and the second amount. Accordingly, when the frame 301 is in the expanded configuration, the membrane 307 can exert a force on the frame 301 such that movement of the frame 301 from the expanded configuration to the collapsed configuration is resisted. Specifically, the membrane 307 can exert a force on the multiple support linkage 302 and 303 when the first support linkage 302 is in the expanded configuration such that movement of the first support linkage from its expanded configuration to its collapsed configuration is resisted. Said another way, the membrane 307 can resist movement of the multiple support linkages 302 and 303 from their respective expanded configuration to their respective collapsed configuration when the first support linkage is in the expanded configuration.

The first support linkage 302 and the second support linkage 303 can collectively move between their respective intermediate configurations and their respective expanded configurations when the first support linkage 302 and the second support linkage 303 are anchored to the support surface S and the first hub 308 is moved upward along direction BB. The user can move the frame 301 from its collapsed configuration to its expanded configuration in one operation by moving the central first hub 308 upward along direction BB. Specifically, the user can move the frame 301 from its intermediate configuration as shown in FIG. 14 to its expanded configuration as shown in FIG. 16. The upward movement of the central first hub 308 along direction BB coupled by the constraint of the second end portion 322 (e.g., the lower end) of the fourth member 320 causes the first support linkage 302 to unfold from its intermediate configuration, M-like shape to its expanded configuration.

Figure 17:
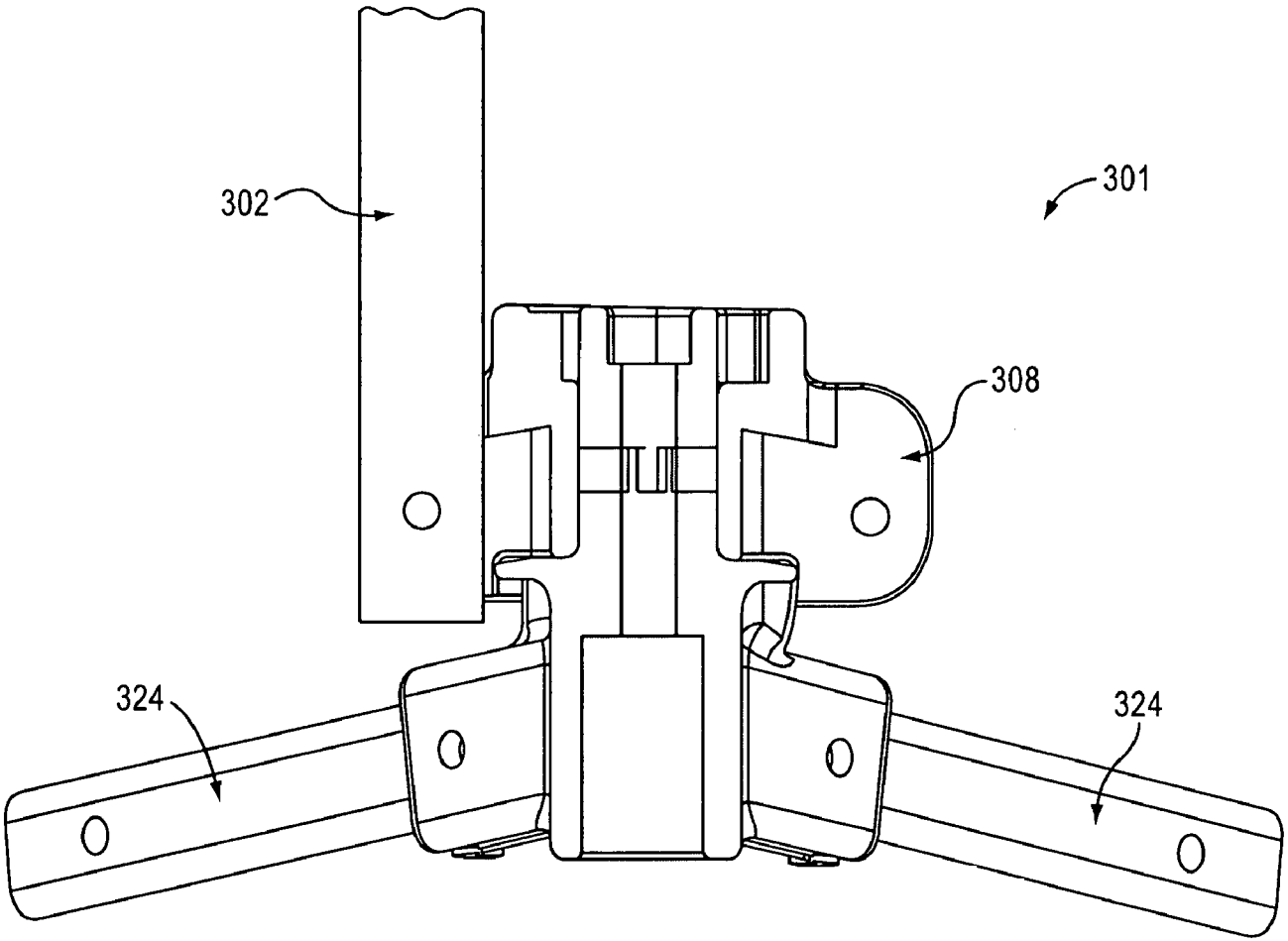
FIGS. 17 and 18 are side views of a hub of a frame.
Figure 18:
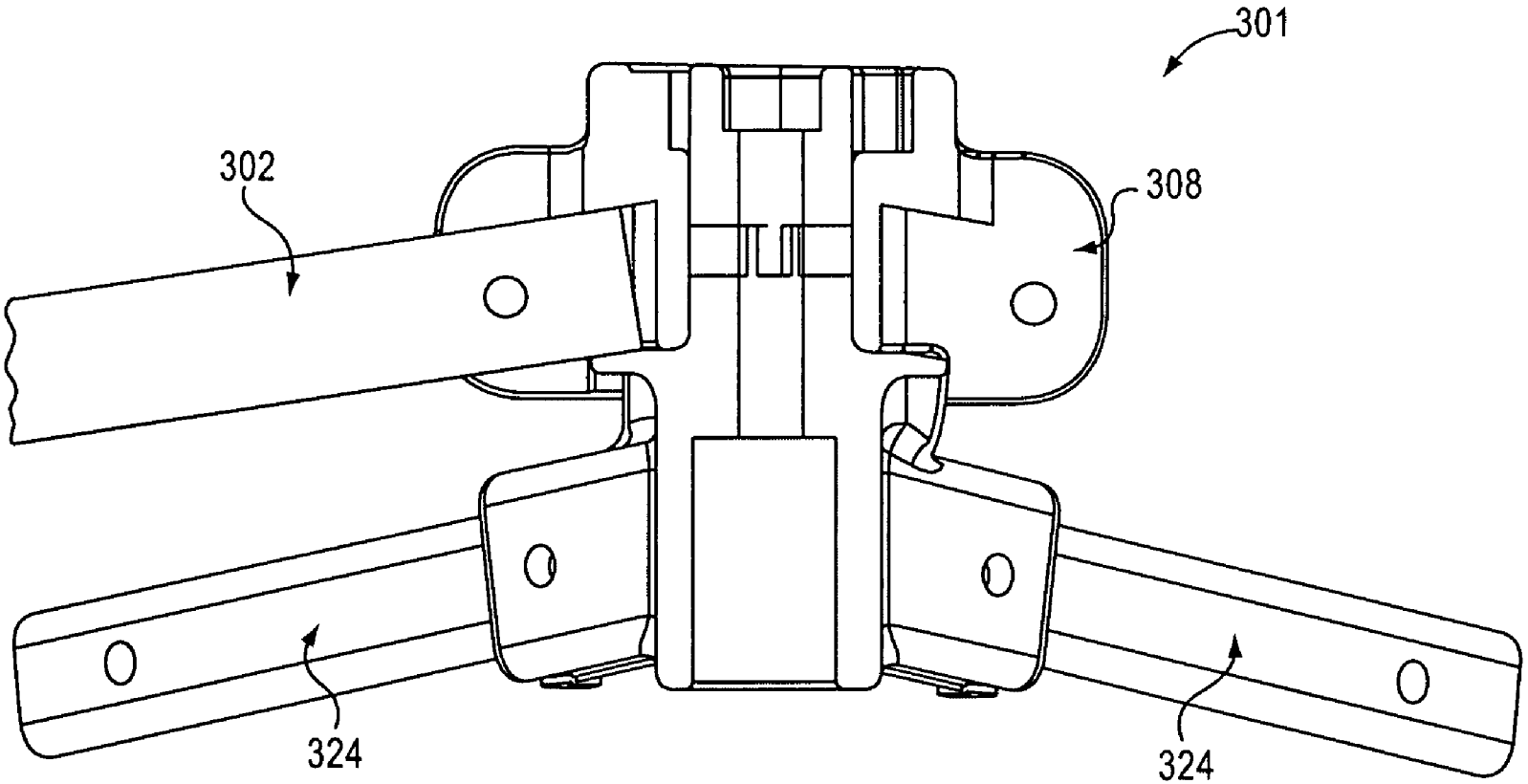

FIGS. 17 and 18 are side views of the first hub 308 of a frame 301 with the first support linkage 302 in its collapsed configuration and its expanded configuration, respectively. As discussed above, the first support linkage 302 of the frame 301 is moveably coupled to the first hub 308. The first hub 308 includes multiple hub support members 324 that enable the first hub 308 to remain in a fixed position relative the support surface S when contacting the support surface S.

In use, the first support linkage 302 is moved from its collapsed configuration as shown in FIG. 9 to its intermediated configuration as shown in FIG. 13 independent of the second support linkage 303. As the first support linkage 302 is independently moved to its intermediated configuration, the hub support members 324 maintain the fixed position of the first hub 308 with respect to the support surface S. Similarly, as the second support linkage 303 is independently moved from its collapsed configuration to its intermediate configuration, the hub support members 324 maintain the fixed position of the first hub 308 with respect to the support surface S. In some embodiments, the hub support members maintain the first hub at the fixed position with respect to the support surface when a third support linkage is independently moved from its collapsed configuration to its intermediate configuration.

FIGS. 19 and 20 are bottom views of the hub of FIGS. 17 and 18. The first hub 308 has a top hub member 336 and a bottom hub member 337 pivotally coupled to the top hub member 336. The top hub member 336 includes an inclined surface 338 that contacts the bottom hub member 337 as the frame 301 moves between its collapsed configuration and its expanded configuration. The top hub member 336 also defines a notch (not shown) in communication with the inclined surface 338 such that the notch can retain the top hub member 336 and the bottom hub member 337 at a fixed position after the bottom hub member 337 rotates over the inclined surface 338 and into the notch. The top hub member 336 and the bottom hub member 337 are always in contact regardless of the configuration of the frame 301.

The first hub 308 includes a locking member 339 having a first position and a second position different than the first position. The locking member 339 can move from its first position to its second position when the first hub 308 is moved from its first position to its second position (e.g., corresponding to when the frame 301 is moved from its collapsed configuration to its expanded configuration) due to the interaction between the bottom hub member 337 and the inclined surface 338 of the top hub member 336.

The locking member 339 can inhibit movement of the first support linkage 302 from the collapsed configuration to the expanded configuration when the locking member 339 is in the second position and the first support linkage 302 is in the collapsed configuration or the expanded configuration. Said differently, the locking member 339 can maintain the frame 301 in its expanded configuration when the locking member 339 is in its second position. Specifically, the locking member 339 inhibits (i.e., blocks) the first support linkage 302 from rotating with respect to the first hub 308 when the locking member 339 is in its second position.

The first hub 308 can maintain the frame 301 in a position such that the longitudinal axis $LA_4$ defined by the fourth member 320 (i.e., the end portion of the first support linkage 302) is substantially normal to the plane defined by the support surface S without external support when the frame 301 is in the collapsed configuration as shown in FIG. 8. Said another way, the first hub 308 can maintain the frame 301 in a position such that the longitudinal axis $LA_4$ of the fourth member 320 (i.e., the end portion of the first support linkage 302) is substantially normal to the plane defined by the support surface S without external support when the frame 301 is in the collapsed configuration.

Although the first hub 308 is described and shown with the top hub member 336 to the bottom hub member 337, it should be understood that, in some embodiments, the top hub member and the bottom hub member can be unitarily formed, and may or may not have a locking member.

FIG. 21 is a perspective view of a shelter 300 disposed in its expanded configuration according to an embodiment. As discussed above, the shelter 300 includes a frame 301 and a membrane 307 coupled to the frame 301. The frame 301 includes the first hub 308 and multiple support linkages 302, 303, 304 and 305 movably coupled to the first hub 308. Specifically, the frame 301 includes the first support linkage 302, the second support linkage 303, the third support linkage 304 and the fourth support linkage 305 disposed within the membrane 307.

Figure 22:
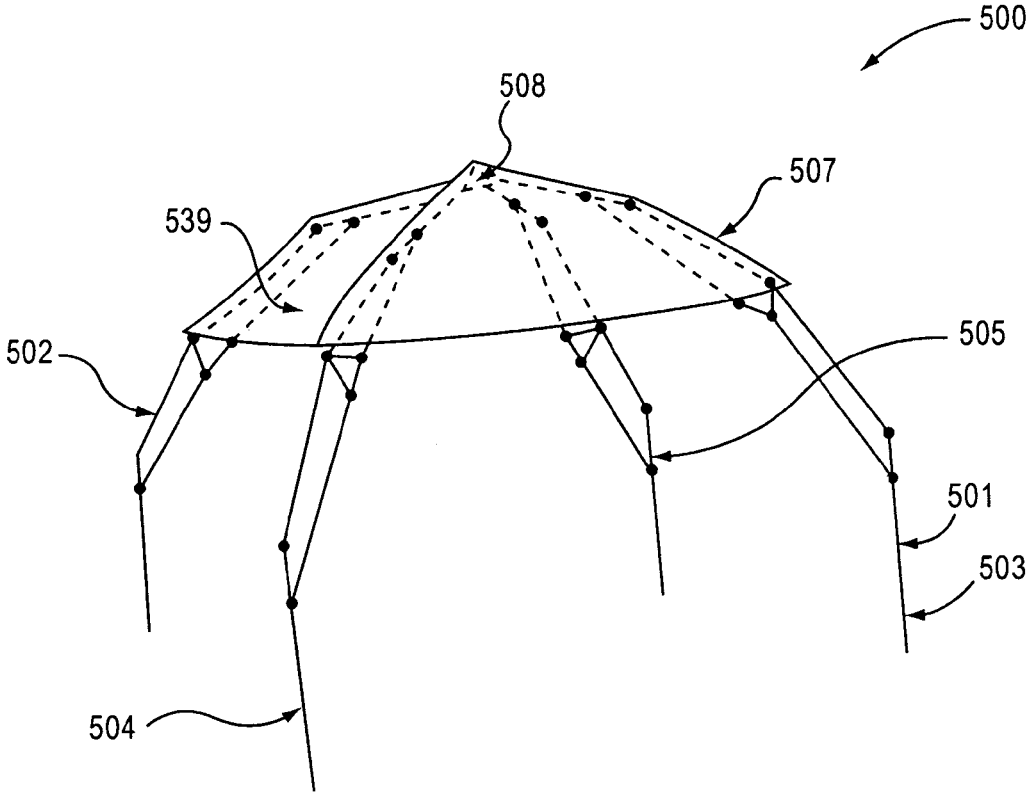
FIG. 22 is a perspective view of a shelter according to an embodiment.

FIG. 22 is a perspective view of a shelter according to an embodiment. A shelter 500 includes a frame 501 and a membrane 507 coupled to the frame 501. The frame 501 includes one (i.e., only one) hub 508 movably coupled to multiple support linkages 502, 503, 504 and 505. Specifically, the frame 501 includes a first support linkage 502, a second support linkage 503, a third support linkage 504 and a fourth support linkage 505. In this embodiment, the membrane 307 is disposed above a top portion 539 of the frame 501 when the shelter is in its expanded configuration and disposed on and anchored to a support surface (not shown).

In some embodiments, the shelter can include a perimeter retaining member that is coupled to the end portion of each of the support linkages such that it maintains a distance between each of the support linkages when the frame is in its expanded configuration and not anchored to a support surface. For example, the perimeter retaining member can be a strap coupled to the end portion of each support linkage. The strap can limit outward movement of the end portion of each support linkage with respect to the other support linkages.

Figure 23:
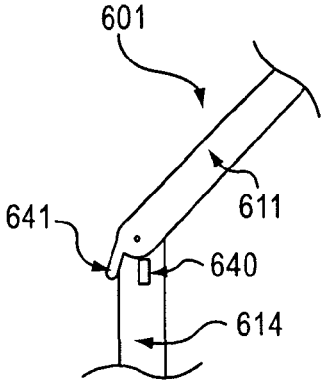
FIGS. 23 and 24 are side views of a portion of the frame disposed in a first configuration and a second configuration, respectively, according to an embodiment.
Figure 24:
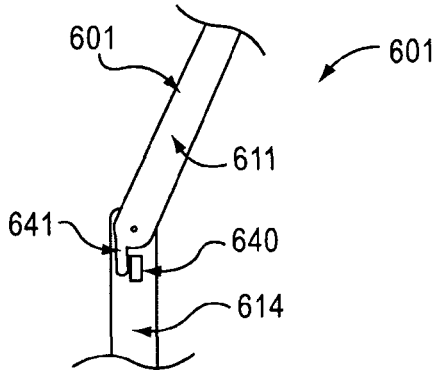

FIGS. 23 and 24 are side views of a portion of the frame disposed in a first configuration and a second configuration, respectively, according to an embodiment. In this embodiment, a frame 601 includes a first member 611 and a second member 614 pivotally coupled to the first member 611. The first member 611 includes a tab 641. The second member 614 includes a retaining member 640. The first member 611 and the second member 614 can resist outward movement beyond the expanded configuration. Specifically, the tab 641 of the first member 611 can engage the retaining member 640 of the second member 614 such that the retaining member 640 inhibits further outward movement of the first member 611 and the second member 614.

Figure 25:
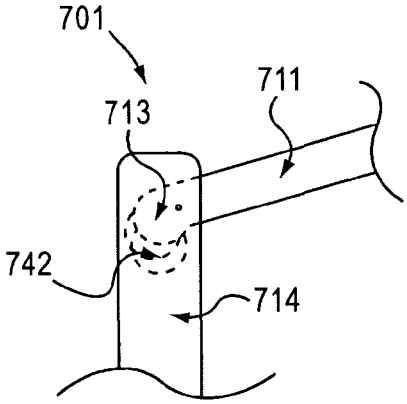
FIG. 25 is a assembly-like view showing internal components of a portion of a frame according to an embodiment.

FIG. 25 is a side view showing internal components of a portion of a frame according to an embodiment. A frame 701 includes a first member 711 and second member 714 coupled together. Specifically, the second end portion 713 of the first member 711 is eccentric. The second member 714 defines an opening 742 that can mate with the eccentric second end portion 713 of the first member 711. This coupling limits the outward movement of the first member 711 with respect to the second member 714 beyond the expanded configuration.

Figure 26:
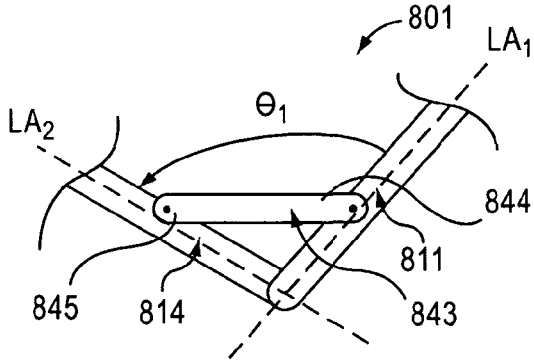
FIGS. 26-28 are side views of a portion of the frame disposed in a first configuration, a second configuration and a third configuration, respectively, according to an embodiment.
Figure 27:
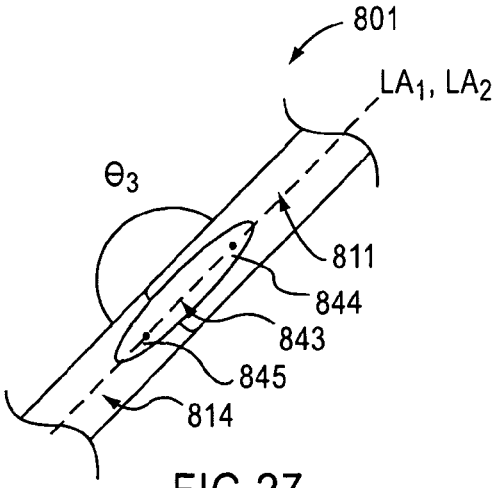
Figure 28:
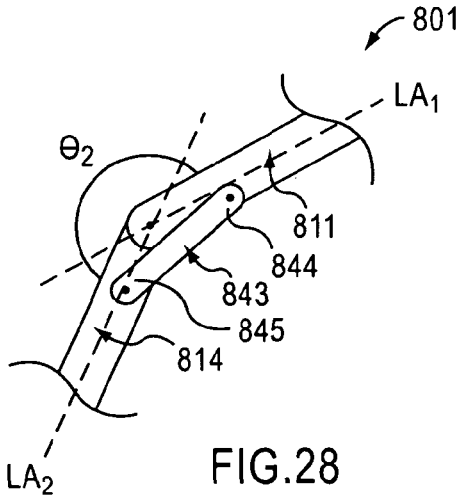

FIGS. 26-28 are side views of a portion of the frame disposed in a first configuration, a second configuration and a third configuration, respectively, according to an embodiment. A frame 801 includes a first member 811 and a second member 814 pivotally coupled to the first member 811. The frame 801 includes an elastic band 843 having a first end portion 844 and a second end portion 845 opposite the first end portion 844. The first end portion 844 of the elastic band is pivotally coupled to the first member 811. The second end portion 845 of the elastic band is pivotally coupled to the second member 814.

An angled $\theta_1$ formed by an intersection between a longitudinal axis $LA_1$ defined by the first member 811 and a longitudinal axis $LA_2$ defined by the second member 814 is less than 180 degrees when the frame 801 is in the first configuration such that the elastic band 843 is deformed by a first amount. The angle $\theta_2$ is greater than 180 degrees when the frame 801 is in the third configuration such that the elastic band 843 is deformed by a second amount. The angle $\theta_3$ is equal to 180 degrees when the frame 801 is in the second configuration such that the elastic band 843 is deformed by a third amount greater than the first amount and greater than the second amount. The elastic band 843 can resist movement towards the second configuration of the frame 801 from either the first or third configuration and, thus, can maintain the frame 801 in its expanded configuration when in its expanded configuration or the collapsed configuration when in its collapsed configuration.

In one embodiment, a method of moving a shelter from its collapsed configuration to its expanded configuration is described herein. A first support linkage of a shelter can be moved from its collapsed configuration to its intermediate configuration. An end portion of the first support linkage can be anchored to a support surface. A second support linkage of the shelter can be moved from its collapsed configuration to its intermediate configuration. The second support linkage can be anchored to the support surface. Movement of the first support linkage between its collapsed configuration and its intermediate configuration is independent of movement of the second support linkage between its collapsed configuration and its intermediate configuration. A hub, moveably coupled to the first support linkage and the second support linkage, can be moved from a first position to a second position such that the first support linkage is moved from its intermediate configuration to its expanded configuration and the second support linkage is moved from its intermediate configuration to its expanded configuration. The expanded configuration of the first support linkage and the expanded configuration of the second support linkage correspond to the expanded configuration of the shelter. The first position of the hub is associated with the collapsed configuration of the shelter. The second position of the hub is associated with the expanded configuration of the shelter. In some embodiments, more than two support linkages are moved from their respective collapsed configuration to their respective intermediate and their respective expanded configurations.

In another embodiment, a method of moving a shelter from its expanded configuration to its collapsed configuration is described. The shelter includes a hub movably coupled to a first support linkage and movably coupled to a second support linkage. The hub has a first position associated with the expanded configuration of the shelter and a second position associated with the collapsed configuration of the shelter. (An end portion of the first support linkage and an end portion of the second support linkage are each previously anchored to a support surface before the shelter was moved into its expanded configuration.) The hub is moved from the first position to the second position such that the first support linkage is moved from its expanded configuration to its intermediate configuration and the second support linkage is moved form its expanded configuration to its intermediate configuration. The end portion of the first support linkage can be de-anchored from the support surface. The first support linkage can be moved from its intermediate configuration to its collapsed configuration. The end portion of the second support linkage can be de-anchored from the support surface. The second support linkage can be moved from its intermediate configuration to its collapsed configuration. Movement of the first support linkage between its intermediate configuration and its collapsed configuration is independent of movement of the second support linkage between its intermediate configuration and its collapsed configuration. In some embodiments, the support linkages can all be de-anchored and then moved from their respective intermediate configuration to their respective collapsed configuration.

While various embodiments have been described above, it should be understood that they have been presented by way of example only, and not limitation. While specific embodiments have been shown, it will be understood that various changes in form and details may be made.

It will be understood by those skilled in the art that various changes in form and details may be made. For example, a support device can include various combinations and subcombinations of the various embodiments described herein.

What is claimed is:

1. An apparatus, comprising:

a plurality of support linkages collectively moveable between a first configuration and a second configuration;

a hub moveably coupled to the plurality of support linkages;

a support linkage from the plurality of support linkages, the support linkage pivotally coupled to the hub, the support linkage being moveable between a collapsed configuration and an expanded configuration when the plurality of support linkages are moved between the first configuration and the second configuration, the support linkage including:

a first member; and a second member unconstrainedly pivotally coupled to the first member, an angle formed by an intersection between a longitudinal axis defined by the first member and a longitudinal axis defined by the second member being less than 180 degrees when the support linkage is in its collapsed configuration, the angle being greater than 180 degrees when the support linkage is in its expanded configuration and such that the first support member and the second member are overextended relative to each other to maintain the support linkage in its expanded configuration, the hub and the plurality of support linkages collectively forming an interior region when the support linkage is in its expanded configuration; and a flexible shell coupled to the plurality of support linkages, the flexible shell configured to be elastically deformed by a first amount when the plurality of support linkages is in its first configuration, the flexible shell configured to be elastically deformed by a second amount when the plurality of support linkages is in its second configuration, the flexible shell configured to be elastically deformed by a third amount greater than the first amount and the second amount when the plurality of support linkages is in an intermediate configuration between its collapsed configuration and its expanded configuration, the flexible shell imparting a force on each support linkage from the plurality of support linkages when the plurality of support linkages is in its second configuration, the force imparted by the flexible shell being sufficient to resist movement of the plurality of support linkages from its second configuration to its first configuration or its intermediate configuration.

2. The apparatus of claim 1, wherein the hub is moveable between a first position and a second position different than the first position, the hub being configured to move the support linkage from the collapsed configuration to the expanded configuration when the hub is moved from the first position to the second position.

3. The apparatus of claim 1, wherein the flexible shell is configured to resist movement of the plurality of support linkages from the second configuration to the first configuration when the support linkage is in the expanded configuration.

4. The apparatus of claim 1, wherein the first member is pivotally coupled to the second member via a coupling member, the support linkage including a first control member having a first end portion and a second end portion opposite the first end portion, the second end portion of the first control member being pivotally coupled to the coupling member, the support linkage including a second control member having a first end portion and a second end portion opposite the first end portion, the first end portion of the second control member being pivotally coupled to the coupling member.

5. The apparatus of claim 1, wherein the support linkage is a first support linkage from the plurality of support linkages, the first support linkage has an intermediate configuration between its collapsed configuration and its expanded configuration, the apparatus further comprising:

a second support linkage from the plurality of support linkages moveably coupled to the hub, the second support linkage having a collapsed configuration, an expanded configuration and an intermediate configuration between its collapsed configuration and its expanded configuration, the first support linkage being independently moveable between its collapsed configuration and its expanded configuration with respect to the second support linkage.

6. The apparatus of claim 1, wherein the support linkage is a first support linkage from the plurality of support linkages, the first support linkage has an intermediate configuration between its collapsed configuration and its expanded configuration, the apparatus further comprising:

a second support linkage from the plurality of support linkages moveably coupled to the hub, the second support linkage having a collapsed configuration, an expanded configuration and an intermediate configuration between its collapsed configuration and its expanded configuration, the second support linkage and the first support linkage are configured to collectively move between their respective intermediate configuration and their respective expanded configuration when the first support linkage and the second support linkage are anchored to a support surface.

7. The apparatus of claim 1, wherein the first member and the second member are collectively configured to resist movement of the support linkage from its expanded configuration to its collapsed configuration when the support linkage is in its expanded configuration.

8. The apparatus of claim 1, wherein the flexible shell is configured to elastically deform when the support linkage moves between its collapsed configuration and its expanded configuration such that the support linkage is maintained in its expanded configuration.

9. The apparatus of claim 1, wherein the support linkage includes a third member having a first end portion and a second end portion opposite the first end portion, the first end portion of the third member being pivotally coupled to the second member, the second end portion of the third member being configured to be anchored to a support surface when the support linkage is in its expanded configuration, a longitudinal axis defined by the third member being substantially normal to a plane defined by the support surface when the support linkage is in the expanded configuration.

10. The apparatus of claim 1, wherein the support linkage includes a third member pivotally coupled to the second member, the hub is configured to maintain the support linkage in the collapsed configuration, a longitudinal axis defined by the third member being substantially normal to a plane defined by a support surface when the support linkage is in the collapsed configuration.

11. An apparatus, including: a frame configured to be moved between a collapsed configuration and an expanded configuration, the frame including:

a first support linkage;

a second support linkage;

a third support linkage, the first support linkage, the second support linkage and the third support linkage each having a first rigid member that extends vertically from a support surface when the frame is in the expanded configuration, each of the first support linkage, the second support linkage and the third support linkage being in an overextension position when the frame is in the expanded configuration to resist movement of the frame from the expanded configuration to the collapsed configuration, the first support linkage, the second support linkage and the third support linkage collectively forming an interior region when the frame is in the expanded configuration; and a flexible shell coupled to the frame, the flexible shell configured to be elastically deformed when the frame is in the expanded configuration and to exert a force on an overextended joint of each of the first support linkage, the second support linkage and the third support linkage when the frame is in the expanded configuration sufficient to maintained the frame in the expanded configuration;

wherein the first support linkage is moveable between a first configuration corresponding to the collapsed configuration of the frame, a second configuration corresponding to the expanded configuration of the frame and a third configuration between the first configuration and the second configuration, the first support linkage including the first rigid member, a second rigid member pivotally coupled to the first rigid member and a third rigid member pivotally coupled to the second rigid member, an angle formed by an intersection between a longitudinal axis defined by the second rigid member and a longitudinal axis defined by the third rigid member being less than 180 degrees when the first support linkage is in the first configuration, the angle being greater than 180 degrees when the first support linkage is in its second configuration such that the flexible shell is deformed a first amount, the angle being equal to 180 degrees when the first support linkage is in the third configuration such that the flexible shell is elastically deformed by a second amount greater than the first amount, and the frame and the flexible shell collectively forming a collapsible portable shelter.

12. The apparatus of claim 11, wherein the flexible shell is elastically deformable such that the flexible shell imparts a force on the frame sufficient to maintain the frame in its expanded configuration when the frame is in its expanded configuration.

13. The apparatus of claim 11, wherein the first support linkage is configured to move through the third configuration when the first support linkage is moved between its first configuration and its second configuration.

14. The apparatus of claim 11, wherein the frame includes a hub pivotally coupled to the first support linkage, the second support linkage and the third support linkage, the hub including a locking member configured to move between a first position and a second position different than the first position, the locking member configured to prevent at least one of the first support linkage, the second support linkage and the third support linkage from pivoting relative to the hub when the locking member is in its second position.

15. The apparatus of claim 11, wherein the frame includes a hub pivotally coupled to the first support linkage, the second support linkage and the third support linkage, the hub including a locking member configured to be moved from a first position to a second position when the frame is moved from its collapsed configuration to its expanded configuration, the locking member configured to maintain the frame in its expanded configuration when the locking member is in its second position.

16. The apparatus of claim 11, wherein a longitudinal axis defined by an end portion of the first rigid member of the first support linkage is substantially normal to a plane defined by a support surface when the frame is in its expanded configuration and when the end portion of the first rigid member of the first support linkage is anchored to the support surface.

17. The apparatus of claim 11, wherein the second member is configured to rotate relative to the first member when the frame is moved from the collapsed configuration to the expanded configuration, the first member having a protrusion configured to engage a portion of the second member when the frame is in the expanded configuration to limit movement of the second member relative to the first member.

18. The apparatus of claim 11, wherein the frame includes a hub coupled to the first support linkage, the second support linkage and the third support linkage, the hub being configured to maintain the frame in a position such that a longitudinal axis defined by an end portion of the first rigid member of the first support linkage is substantially normal to a plane defined by a support surface without external support when the frame is in the collapsed configuration.

19. An apparatus, comprising:

a frame being moveable between a collapsed configuration and an expanded configuration, the frame including a plurality of rigid support linkages and a hub, each support linkage from the plurality of support linkages being pivotally coupled to the hub, each support linkage from the plurality of support linkages having a vertically extending portion and an angled portion when the frame is in the expanded configuration, each support linkage from the plurality of support linkages being in an overextension position such that the frame is maintained in the expanded configuration the hub including a locking member moveable between a first position and a second position, the locking member configured to permit movement of the plurality of support linkages with respect to the hub when the locking member is in its first position, the locking member configured to inhibit movement of at least one support linkage of the plurality of support linkages with respect to the hub when the locking member is in its second position, the locking member being moveable to its second position when the plurality of support linkages is in its collapsed configuration and when the plurality of support linkages is in its expanded configuration; and a membrane coupled to the frame, the membrane and the frame configured to collectively define an interior region when the frame is in the expanded configuration, the frame being disposed between the membrane and the interior region at least along an entire length of the vertically extending portions of each support linkage from the plurality of support linkages, the membrane configured to exert a force on the frame when the frame is in its expanded configuration sufficient to resist movement of the frame from the expanded configuration to the collapsed configuration.

20. The apparatus of claim 19, wherein the frame has an intermediate configuration between the collapsed configuration and the expanded configuration, the frame configured to elastically deform the membrane by a first amount when in the expanded configuration, the frame configured to elastically deform the membrane by a second amount when in the intermediate configuration, the second amount being greater than the first amount.

21. The apparatus of claim 19, wherein a rigid support linkage from the plurality of rigid support linkages has a first configuration corresponding to the collapsed configuration of the frame, a second configuration corresponding to the expanded configuration of the frame and a third configuration between the first configuration and the second configuration, the support linkage including a first rigid member, a second rigid member pivotally coupled to the first rigid member and a third rigid member pivotally coupled to the second rigid member, an angle formed by an intersection between a longitudinal axis defined by the second member and a longitudinal axis defined by the third member being greater than 180 degrees when the rigid support linkage is in its second configuration such that the flexible shell is deformed up to a first amount, the angle being equal to 180 degrees when the rigid support linkage is in its third configuration such that the flexible shell is deformed up to a second amount greater than the first amount.

22. The apparatus of claim 19, wherein a longitudinal axis defined by an end portion of a rigid support linkage from the plurality of rigid support linkages is substantially normal to a plane defined by a support surface when the frame is in its expanded configuration and when the end portion is anchored to the support surface.

23. The apparatus of claim 19, wherein the frame includes a hub pivotally coupled to the plurality of rigid support linkages, the hub including a locking member configured to be moved between a first position and a second position different from the first position, the locking member configured to prevent at least one rigid support linkage from the plurality of rigid support linkages from pivoting relative to the hub when the locking member is in its second position.

24. The apparatus of claim 19, wherein the frame includes one and only one hub, a first rigid support linkage from the plurality of rigid support linkages is pivotally coupled to one and only one location of the one and only one hub.

25. An apparatus, comprising:

a plurality of support linkages, the plurality of support linkages collectively having a first configuration and a second configuration, the plurality of support linkages defining an interior region when in the second configuration;

one and only one hub configured to be movably coupled to the plurality of support linkages;

a support linkage from the plurality of support linkages, the support linkage being moveable between a collapsed configuration and an expanded configuration, the support linkage and the hub collectively forming a portion of a collapsible portable shelter, the support linkage including:

a first member pivotally coupled to the hub at one and only one location of the hub;

a second member pivotally coupled to the first member;

a third member pivotally coupled to the second member; and a fourth member pivotally coupled to the third member, the fourth member being configured to be anchored to a support surface when the support linkage is in the expanded configuration, the fourth member defining a longitudinal axis substantially normal to a plane defined by the support surface when the support linkage is in its expanded configuration, an angle formed by an intersection between a longitudinal axis defined by the second member and a longitudinal axis defined by the third member being less than 180 degrees when the first support linkage is in its collapsed configuration, the angle being greater than 180 degrees when the first support linkage is in its expanded configuration; and a flexible shell coupled to the plurality of support linkages such that the plurality of support linkages is disposed between the flexible shell and the interior region at least along an entire length of the fourth member of the support linkage, the flexible shell elastically deforming when the plurality of support linkages is in the second configuration such that each support linkage from the plurality of support linkages is maintained in the second configuration, the flexible shell exerting a force on each support linkage from the plurality of support linkages in a first direction and a force on the support linkage in a second direction different than the first direction when that support linkage is in its expanded configuration sufficient to maintain that support linkage in its expanded configuration.

26. The apparatus of claim 25, wherein the support linkage excludes a control member coupled to the hub and the support linkage.

27. The apparatus of claim 25, wherein the support linkage is a first support linkage from the plurality of support linkages, the apparatus further comprising:

a second support linkage from the plurality of support linkages coupled to one and only one location of the hub, the second support linkage being independently moveable with respect to the first support linkage.

28. The apparatus of claim 25, wherein the hub is moveable between a first position and a second position different than the first position, the hub configured to maintain the support linkage in the collapsed configuration when the hub is in its first position, the longitudinal axis defined by the fourth member being substantially normal to the plane defined by the support surface when the support linkage is in the collapsed configuration, the hub configured to move the support linkage from the collapsed configuration to the expanded configuration when the hub is moved from the first position to the second position.

29. The apparatus of claim 25, wherein the support linkage includes:

a coupling member;

a first control member having a first end portion and a second end portion opposite the first end portion, the first end portion being pivotally coupled to the first member, the second end portion being pivotally coupled to the coupling member; and a second control member having a first end portion and a second end portion opposite the first end portion, the first end portion being pivotally coupled to the coupling member, the second end portion being pivotally coupled to the fourth member.

30. An apparatus, comprising:

a first support linkage having a first end portion and a second end portion;

a second support linkage having a first end portion and a second end portion;

a hub movably coupled to the first end portion of the first support linkage and the first end portion of the second support linkage, the first support linkage being moveable between a collapsed configuration, an expanded configuration and an intermediate configuration, the intermediate configuration being between the collapsed configuration and the expanded configuration, the first support linkage including:

a first member pivotally coupled to the hub;

a second member pivotally coupled to the first member;

a third member pivotally coupled to the second member; and a fourth member pivotally coupled to the third member, the fourth member configured to be anchored to a support surface when the first support linkage is in the expanded configuration, the fourth member defining a longitudinal axis substantially normal to a plane defined by a support surface when the support linkage is in the expanded configuration, the hub including a locking member configured to selectively inhibit movement of the first member with respect to the hub when the first support linkage is in its collapsed configuration;

an angle formed by an intersection between a longitudinal axis defined by the second member and a longitudinal axis defined by the third member being less than 180 degrees when the first support linkage is in its collapsed configuration, the angle being greater than 180 degrees when the first support linkage is in its expanded configuration; and the second support linkage being moveable between a collapsed configuration, an expanded configuration and an intermediate configuration, the intermediate configuration of the second support linkage being between the collapsed configuration of the second support linkage and the expanded configuration of the second support linkage, the first support linkage being independently moveable with respect to the second support linkage when moved between its collapsed configuration and its intermediate configuration, the hub, the first support linkage and the second support linkage collectively forming a portion of a collapsible portable shelter defining an interior region when the first support linkage and the second support linkage are in their expanded configurations, the hub and the second end portions of each of the first support linkage and the second support linkage being in contact with the support surface when the first support linkage and the second support linkage are in their collapsed configurations; and a flexible shell coupled to the first support linkage and the second support linkage such that the first support linkage is disposed between the flexible shell and the interior region at least along an entire length of the fourth member of the first support linkage, the flexible shell elastically deforming when the first support linkage and the second support linkage are each moved from their collapsed configurations to their expanded configurations such that the first support linkage and the second support linkage are each maintained in their expanded configuration.

31. The apparatus of claim 30, wherein the first support linkage and the second support linkage are configured to collectively move between their respective intermediate configurations and their respective expanded configurations when the second end portions of each support linkage is anchored to the support surface and when the hub is moved from the first position to the second position.

32. The apparatus of claim 30, wherein the hub is a first hub, the collapsible portable shelter being devoid of a second hub.

33. The apparatus of claim 30, wherein the flexible shell is configured to resist outward expansion of the first support linkage and the second support linkage when the first support linkage and the second support linkage are each in their expanded configuration.

34. An apparatus, comprising:

a hub configured to be movably coupled to a plurality of support linkages; and a support linkage from the plurality of support linkages, the support linkage being moveable between a collapsed configuration and an expanded configuration, the support linkage including:

a first member pivotally coupled to the hub;

a second member pivotally coupled to the first member;

a third member pivotally coupled to the second member; and a fourth member pivotally coupled to the third member, the fourth member being linear and defining only a single longitudinal axis, the hub configured to maintain the support linkage in the collapsed configuration without external support such that the longitudinal axis defined by the fourth member is substantially normal to a plane defined by a support surface, the longitudinal axis defined by the fourth member is substantially normal to the plane defined by the support surface when the support linkage is in the expanded configuration, an angle formed by an intersection between a longitudinal axis defined by the second member and a longitudinal axis defined by the third member being less than 180 degrees when the support linkage is in the collapsed configuration, the angle being greater than 180 degrees when the support linkage is in the expanded configuration, the second member being moveable with respect to the third member through a range of motion of between 0 degrees and 360 degrees, the hub and the support linkage collectively form a portion of a collapsible portable shelter.

35. The apparatus of claim 34, further comprising:

the plurality of support linkages pivotally coupled to the hub; and a membrane coupled to the plurality of support linkages; the membrane configured to elastically deform when the support linkage from the plurality of support linkages is moved between its collapsed configuration and its expanded configuration such that the support linkage from the plurality of support linkages is maintained in its expanded configuration.

36. The apparatus of claim 34, the hub includes a locking member having a first position and a second position different from the first position, the locking member configured to inhibit movement of the support linkage from the expanded configuration to the collapsed configuration when the locking member is in the second position.

37. The apparatus of claim 34, wherein the hub is a first hub, the collapsible portable shelter being devoid of a second hub.

38. The apparatus of claim 34, further comprising:

the plurality of support linkages coupled to the hub; and a membrane coupled to the plurality of support linkages, the membrane configured to exert a force on the plurality of support linkages when the support linkage from the plurality of support linkages is in its expanded configuration such that the movement of the support linkage from the plurality of support linkages from its expanded configuration to its collapsed configuration is resisted.

39. An apparatus, comprising:

a tent frame configured to be moved between a collapsed configuration and an expanded configuration, the tent frame having:

a plurality of support linkages, at least one of the plurality of support linkages including an elongate member, a first end of the elongate member configured to be anchored to a support surface when the tent frame is in the expanded configuration, the plurality of support linkages being in an overextension position when the tent frame is in the expanded configuration to resist movement of the frame from the expanded configuration to the collapsed configuration, a longitudinal axis of the elongate member is substantially normal to the support surface when the tent frame is in the expanded configuration; and a hub configured to be moveably coupled to the plurality of support linkages, such that a portion of the hub is in contact with the support surface and the longitudinal axis of the elongate member is substantially normal to the support surface when the tent frame is in the collapsed configuration, the hub being moveable relative to the plurality of support linkages between a first position and a second position different than the first position, the portion of the hub being in contact with the support surface when the hub is in the first position, the portion of the hub being spaced apart from the support surface when in the second position, the first end of the elongate member being in contact with the support surface when the hub is in the first position and when the hub is in the second position, the hub including a locking member moveable between a first position and a second position, the locking member configured to permit movement of the plurality of support linkages with respect to the hub when the locking member is in its first position, the locking member configured to inhibit movement of at least one support linkage of the plurality of support linkages with respect to the hub when the locking member is in its second position, the locking member being moveable to its second position when the tent frame is in its collapsed configuration and when the tent frame is in its expanded configuration.

40. The apparatus of claim 39, wherein:

the hub is configured to move the tent frame from the collapsed configuration to the expanded configuration when the hub is moved from the first position to the second position.

41. The apparatus of claim 39, wherein:

the locking member is configured to inhibit movement of the tent frame from the expanded configuration to the collapsed configuration when the locking member is in the second position.

42. The apparatus of claim 39, wherein:

the locking member is configured to inhibit movement of the tent frame from the expanded configuration to the collapsed configuration when the locking member is in the second position, the locking member configured to move from its first position to its second position when the hub is moved from its first position to its second position.

43. The apparatus of claim 39, further comprising:

a flexible member coupled to the plurality of support linkages, the flexible member configured to exert a force on the plurality of support linkages when the tent frame is in its expanded configuration such that the movement of the tent frame from its expanded configuration to its collapsed configuration is resisted.

44. The apparatus of claim 34, wherein when the support linkage is in its expanded configuration, the second member and the third member are overextended relative to each other to prevent the support linkage from moving to its collapsed configuration.

* * * * *

UNITED STATES PATENT AND TRADEMARK OFFICE

CERTIFICATE OF CORRECTION

PATENT NO. : 8,186,369 B2
APPLICATION NO. : 12/153183
DATED : May 29, 2012
INVENTOR(S) : David L. Reeb It is certified that error appears in the above-identified patent and that said Letters Patent is hereby corrected as shown below:

Column 21, line 37, delete “support”.

Column 23, line 36, replace “maintained” with -- maintain --.

Signed and Sealed this
Eleventh Day of September, 2012

David J. Kappos
*Director of the United States Patent and Trademark Office*